US005740959A

United States Patent [19]

Savage

[11] Patent Number: 5,740,959

[45] Date of Patent: Apr. 21, 1998

[54] PRE-WRAPPED GIFT PACKAGE

[76] Inventor: Tommy R. Savage, 2871 Via Martens, Anaheim, Calif. 92806

[21] Appl. No.: 15,209

[22] Filed: Mar. 25, 1993

Related U.S. Application Data

[63] Continuation-in-part of Ser. No. 933,493, Aug. 21, 1992, Pat. No. 5,245,815.

[51] Int. Cl.[6] ..... B65D 75/08; B65D 77/24

[52] U.S. Cl. ..... 229/103.3; 53/241; 53/255; 53/458; 53/473; 53/566; 229/923

[58] Field of Search ..... 53/457, 458, 473, 53/169, 566, 218, 219, 241, 255, 256; 206/282, 283; 229/40, 923, 103.3; 248/152, 318

[56] References Cited

U.S. PATENT DOCUMENTS

| | | | |
|---|---|---|---|
| 1,796,630 | 3/1931 | Stokes | 493/110 |
| 2,015,202 | 9/1935 | Stokes | 493/110 |
| 2,294,690 | 9/1942 | Perry | 229/6 |
| 2,479,456 | 8/1949 | Arthur | 229/87.19 |
| 2,887,834 | 5/1959 | Guyer | 53/458 |
| 2,962,853 | 12/1960 | Howe, Jr. | 53/219 |
| 3,049,059 | 8/1962 | Burt | 493/110 |
| 3,343,750 | 9/1967 | Desmond et al. | 229/923 |
| 3,358,420 | 12/1967 | Fellner et al. | 53/219 |
| 3,366,304 | 1/1968 | Peckar et al. | 229/923 |
| 3,391,856 | 7/1968 | Siegler et al. | 229/87 |
| 3,394,867 | 7/1968 | Gregg | 229/87.19 |
| 3,443,739 | 5/1969 | Adams, Jr. | 229/923 |
| 3,451,611 | 6/1969 | Adams, Jr. | 229/37 |
| 3,459,358 | 8/1969 | Adams, Jr. | 229/37 |
| 3,460,738 | 8/1969 | Adams, Jr. et al. | 229/37 |
| 3,590,699 | 7/1971 | Foley, Jr. et al. | 493/110 |
| 3,790,064 | 2/1974 | Kramer | 229/923 |
| 3,790,069 | 2/1974 | Straccamore | 229/87 R |
| 3,829,005 | 8/1974 | Hackenberg et al. | 229/39 R |
| 3,833,164 | 9/1974 | Dagostine | 229/87.19 |
| 3,851,815 | 12/1974 | Desmond et al. | 229/87 R |
| 3,945,415 | 3/1976 | Febuary | 206/282 |
| 4,005,814 | 2/1977 | Foster | 229/39 R |
| 4,291,516 | 9/1981 | Warner et al. | 53/219 |
| 4,662,150 | 5/1987 | Johnson et al. | 53/458 |
| 4,967,952 | 11/1990 | Roessiger | 229/87.19 |
| 5,020,302 | 6/1991 | Buchman et al. | 53/473 |
| 5,100,051 | 3/1992 | Triglia et al. | 229/923 |
| 5,175,976 | 1/1993 | Petry et al. | 53/566 |
| 5,245,815 | 9/1993 | Savage | 53/458 |

FOREIGN PATENT DOCUMENTS

| | | | |
|---|---|---|---|
| 38770 | 10/1981 | European Pat. Off. | 206/282 |
| 639298 | 6/1928 | France | 206/282 |

*Primary Examiner*—Gary E. Elkins
*Attorney, Agent, or Firm*—Robbins, Berliner & Carson

[57] ABSTRACT

The present invention provides a method of forming a pre-wrapped gift package which appears to have been hand wrapped. The method includes forming a sheet of box construction material with decorative paper affixed thereto into a box tube by joining ends thereof. The box construction material is properly creased and provided with flaps so that a consumer may fold the flattened box tube into a box so that the end flaps form ends of the box and the decorative paper forms a pair of paper flaps which may be overlapped and taped. A flattened pull bow is provided to form a gift wrapping kit with the flattened box tube which may be distributed and displayed in a flat package. A flattened, collapsed open box with the same volume as the pre-wrapped gift package is attached to the outside of the assembly in such a manner that a prospective purchaser may erect the open box and use it to determine whether or not the pre-wrapped gift package is the proper size for the gift the purchaser desires to be packaged. A device which provides an easy way of loading an open ended pre-wrapped gift box is also provided.

6 Claims, 14 Drawing Sheets

FIG. 1
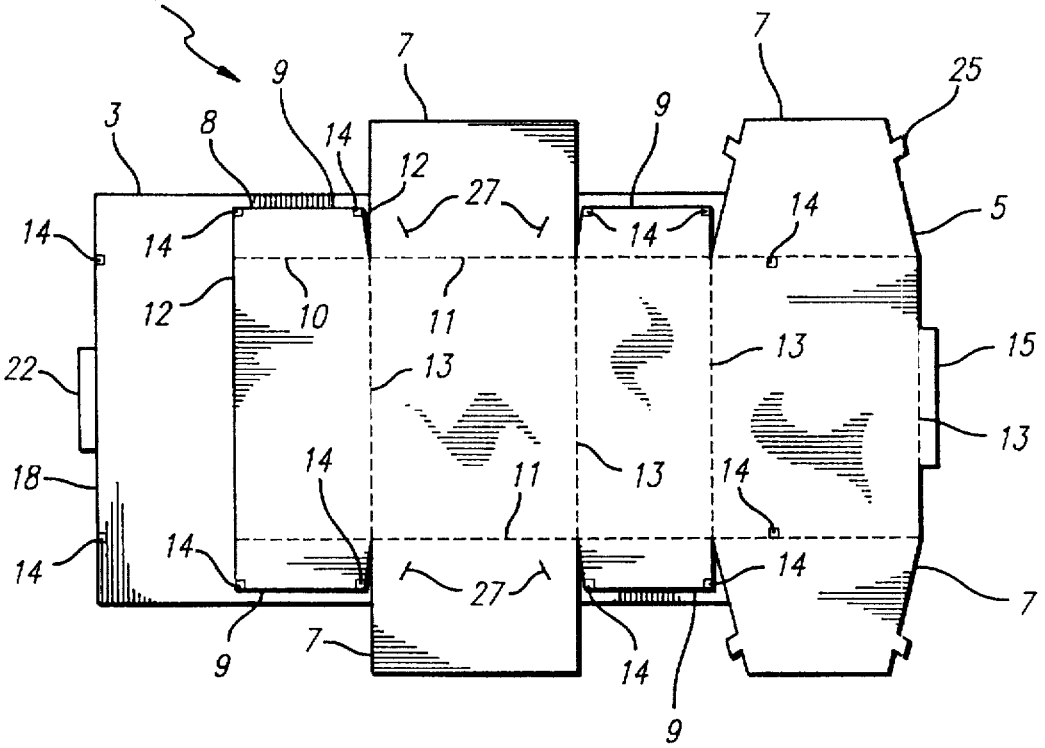
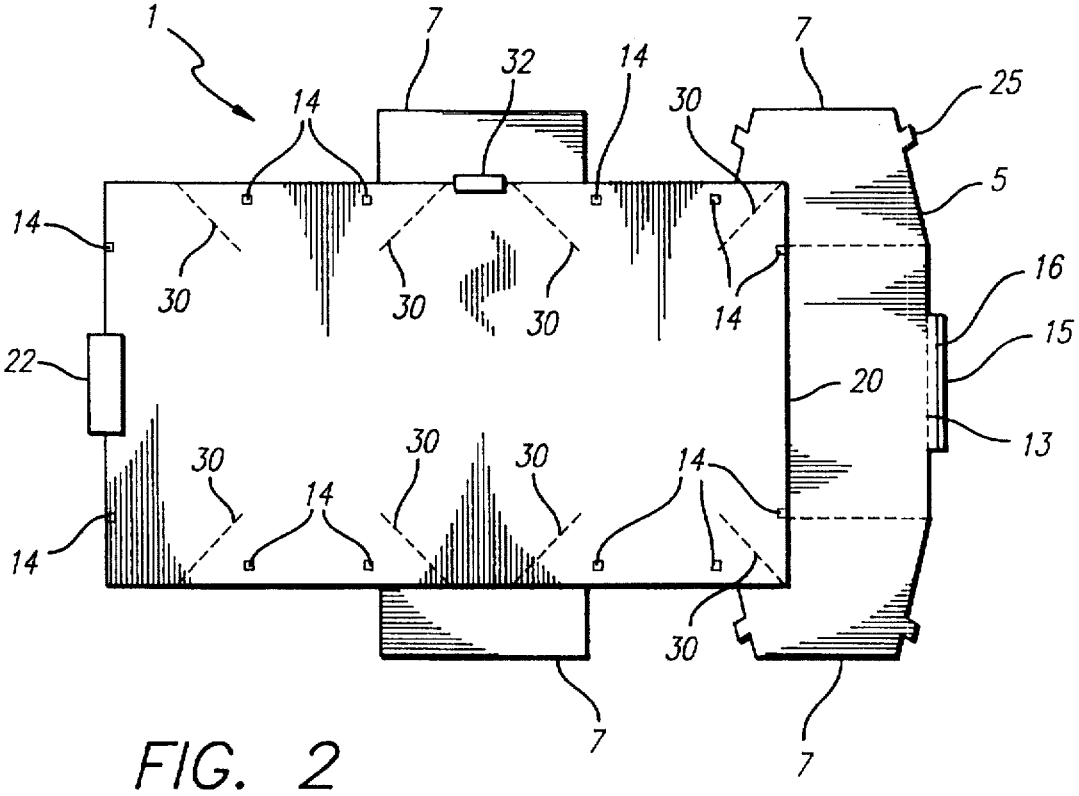
FIG. 2

FIG. 3
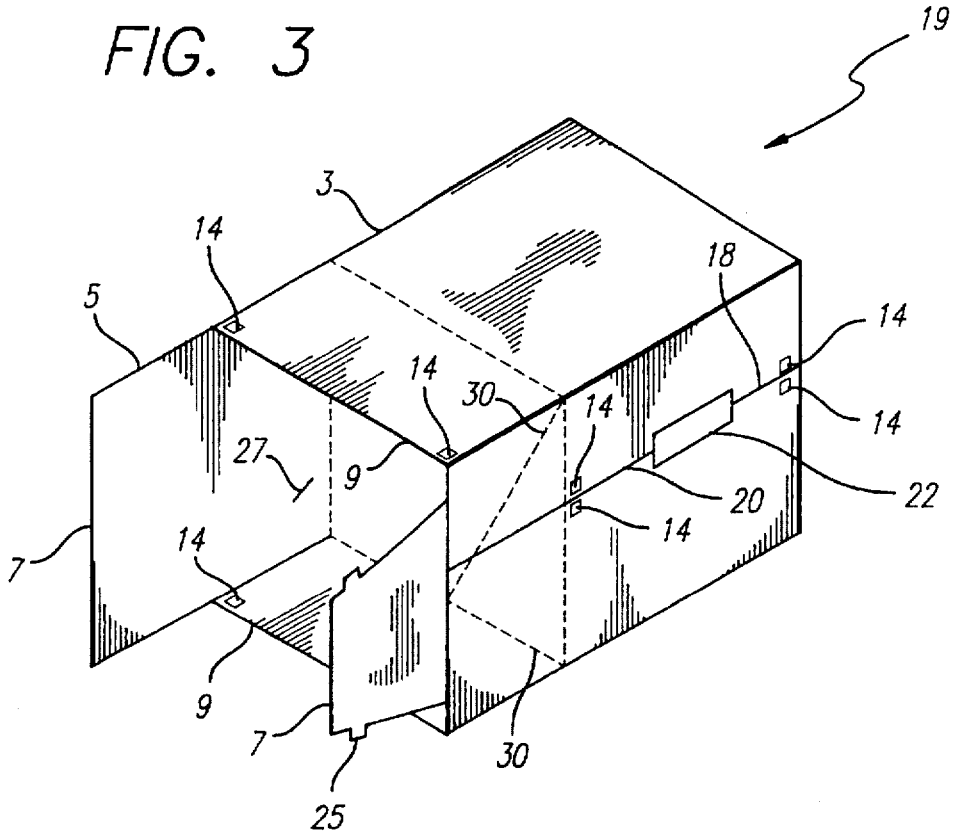
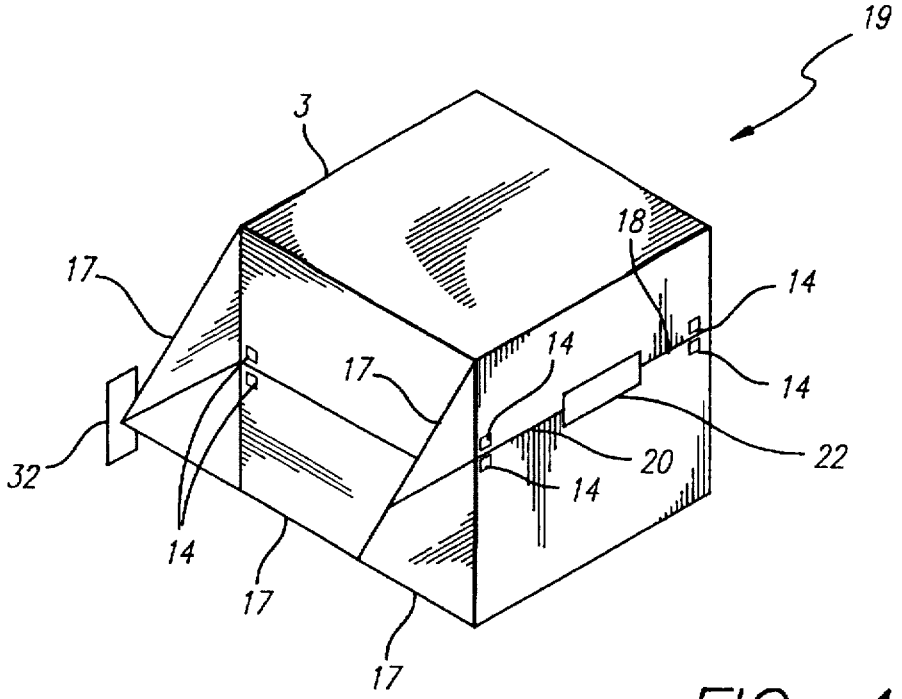
FIG. 4

FIG. 10
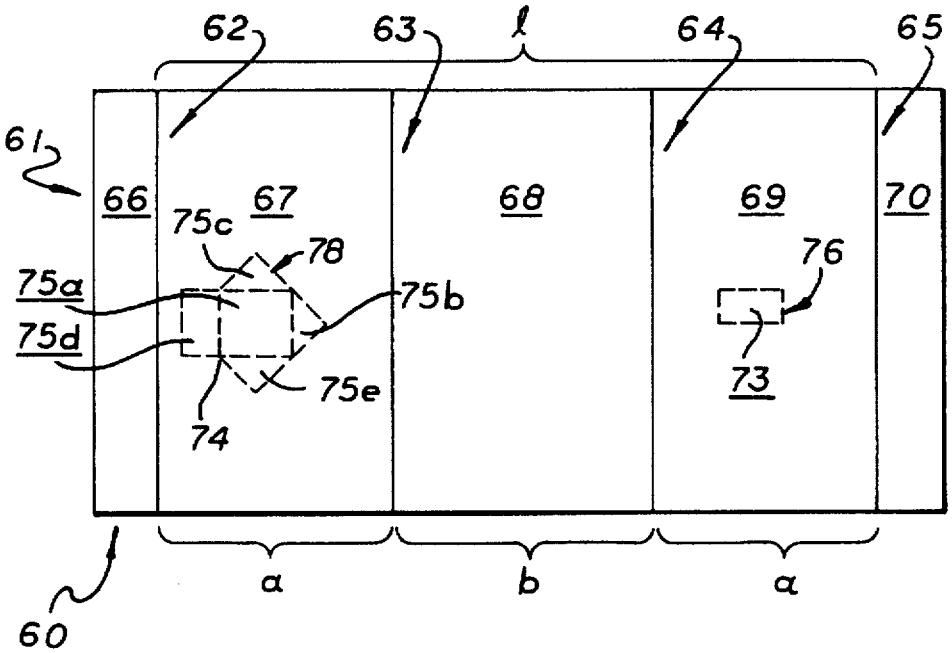
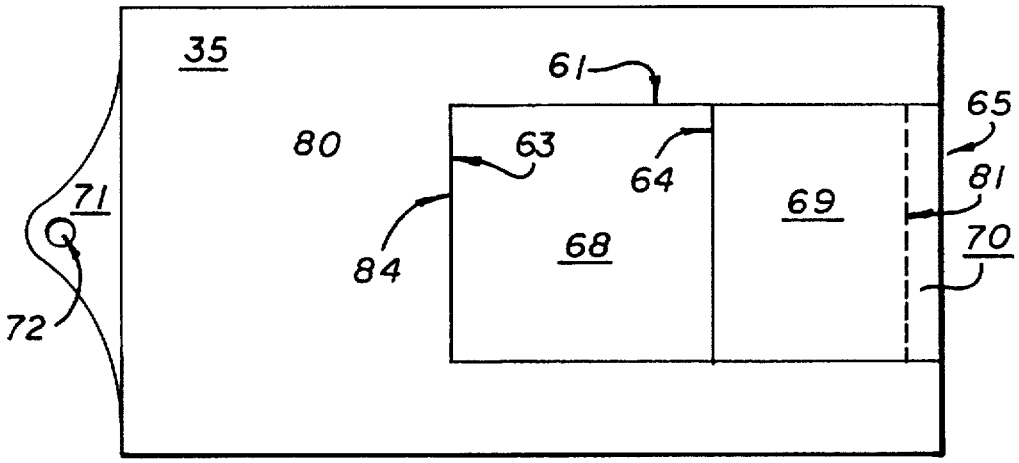
FIG. 11

FIG. 12
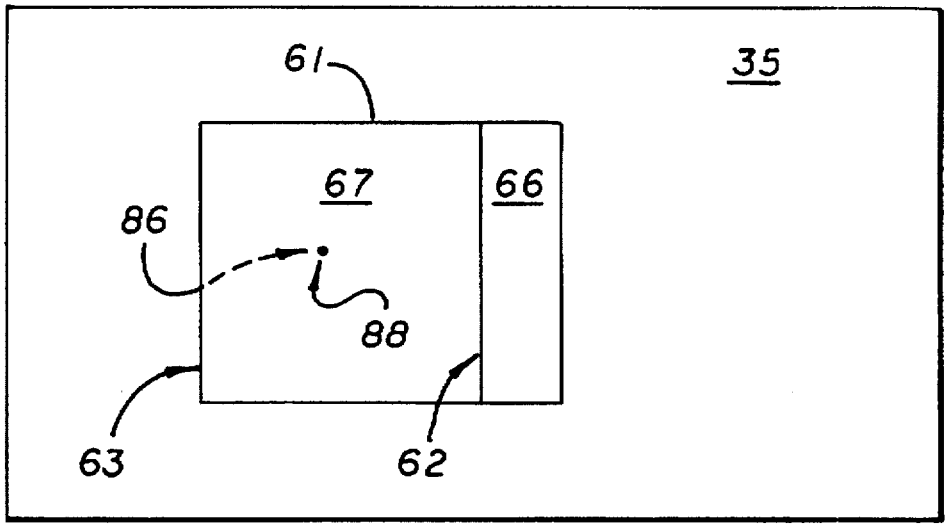
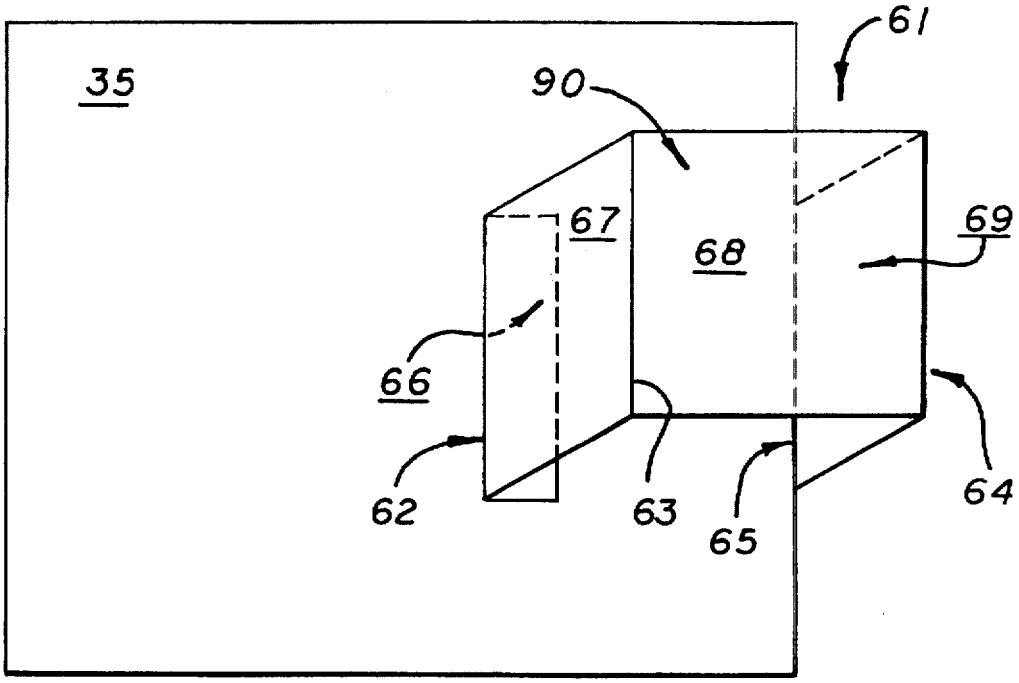
FIG. 13

FIG. 14
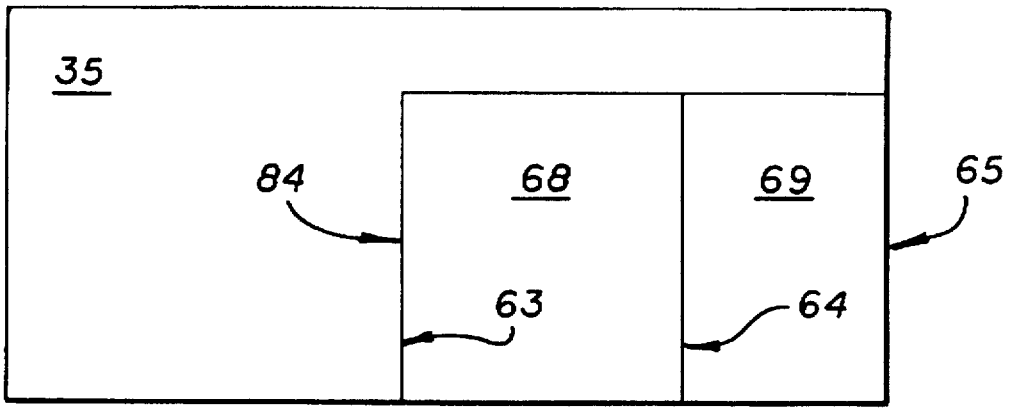
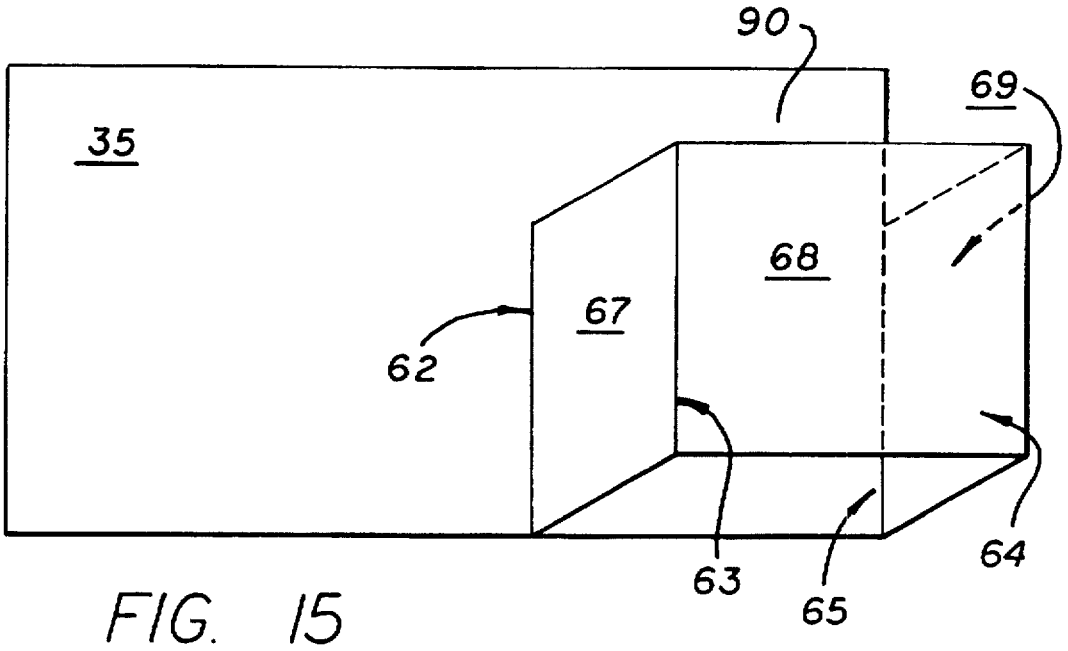
FIG. 15

FIG. 16
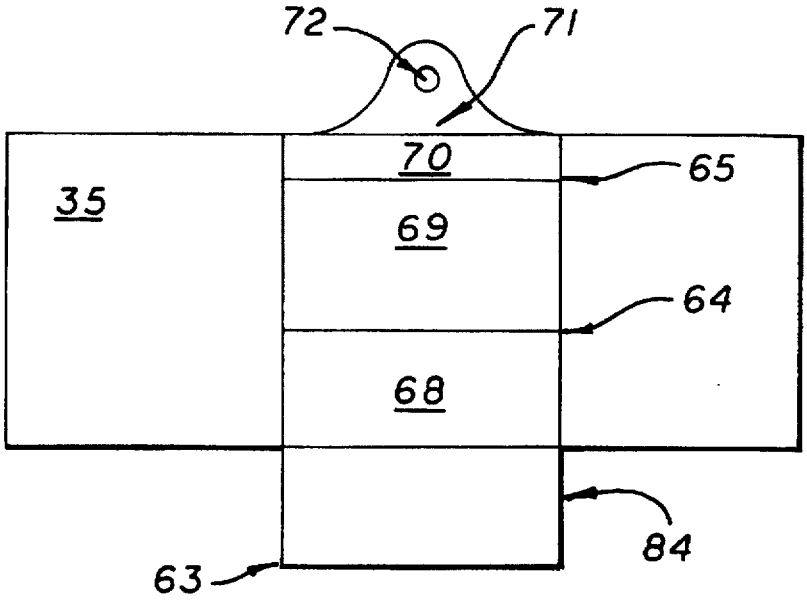
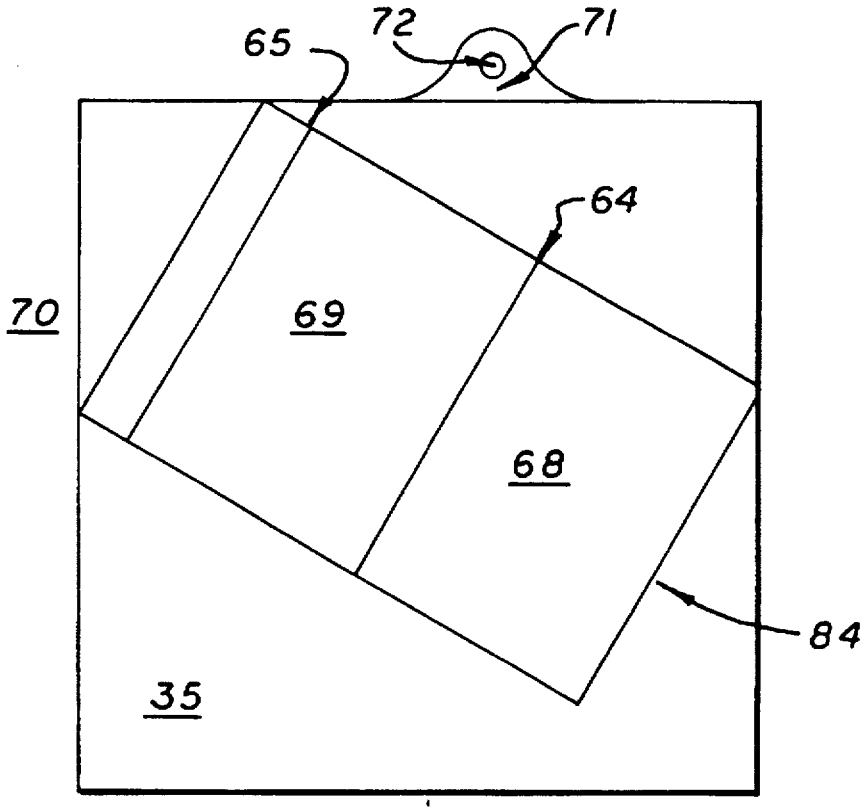
FIG. 17

FIG. 23
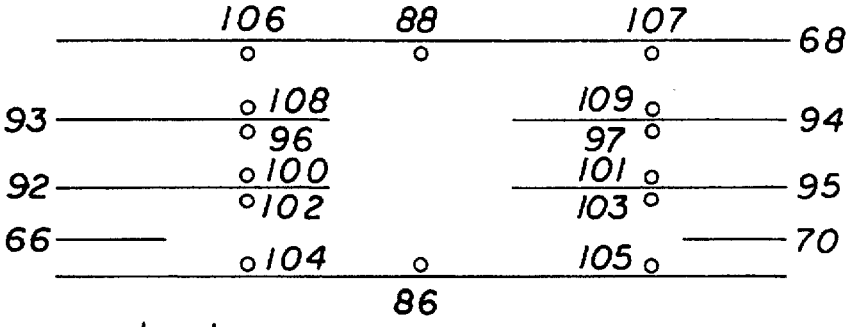
FIG. 24b
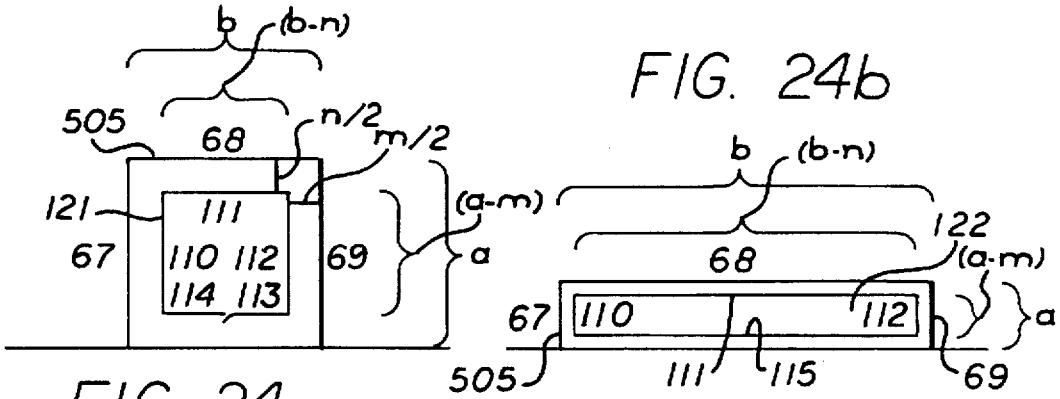
FIG. 24a
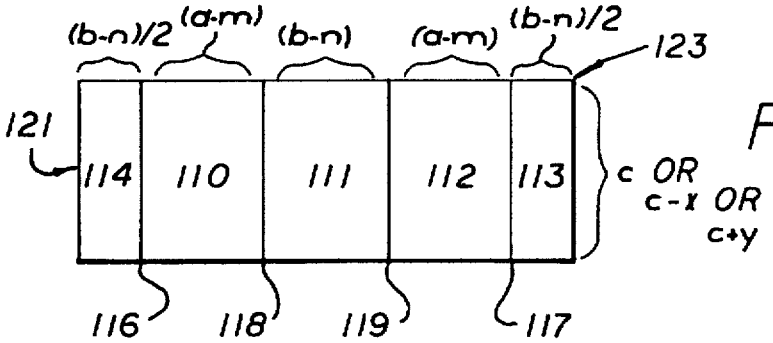
FIG. 25
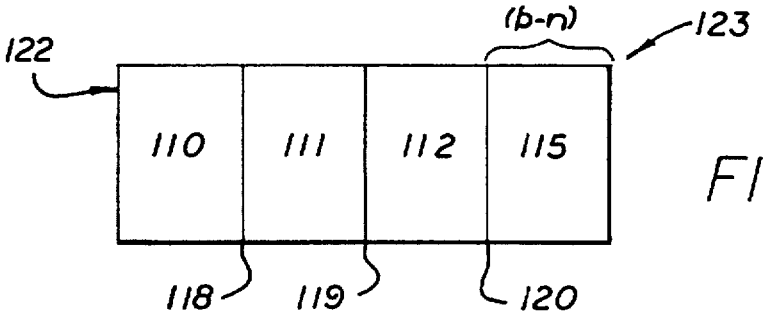
FIG. 26

FIG. 28
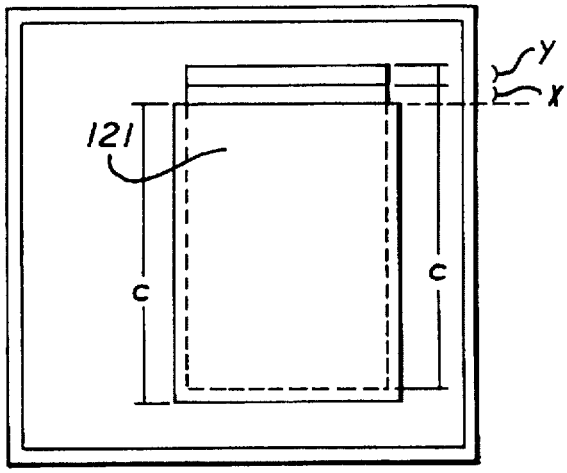
FIG. 29a
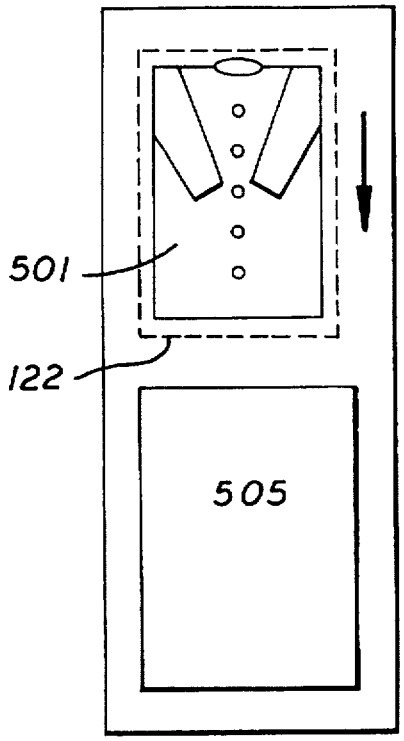
FIG. 29b
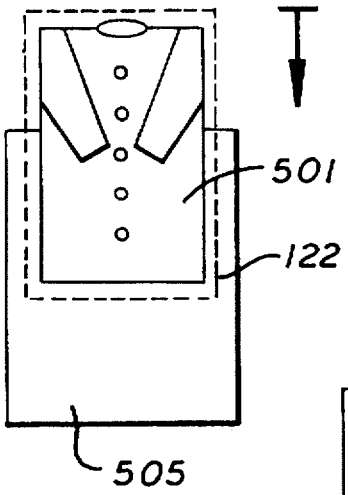
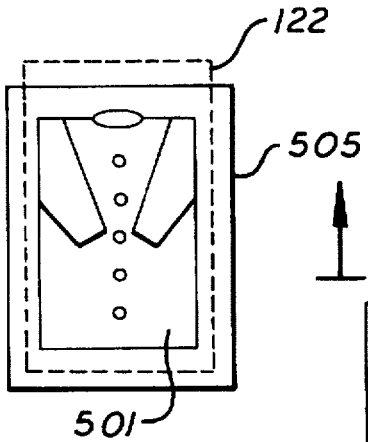
FIG. 29c
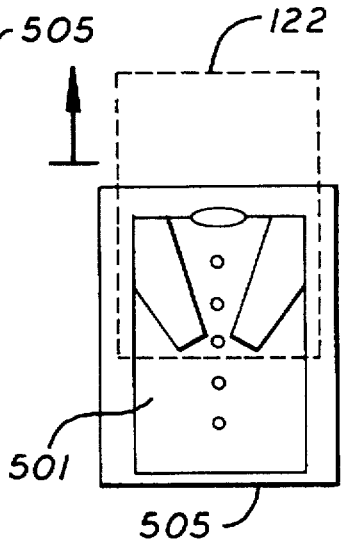
FIG. 29d FIG. 30
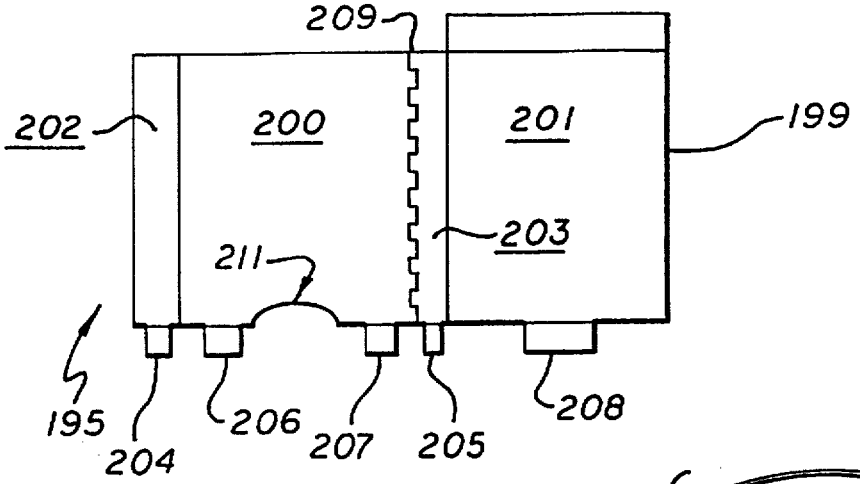
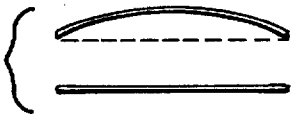
FIG. 31
FIG. 34
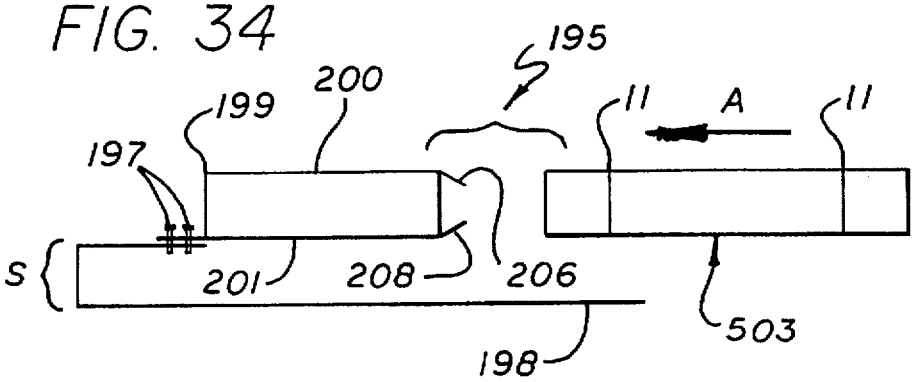
FIG. 32
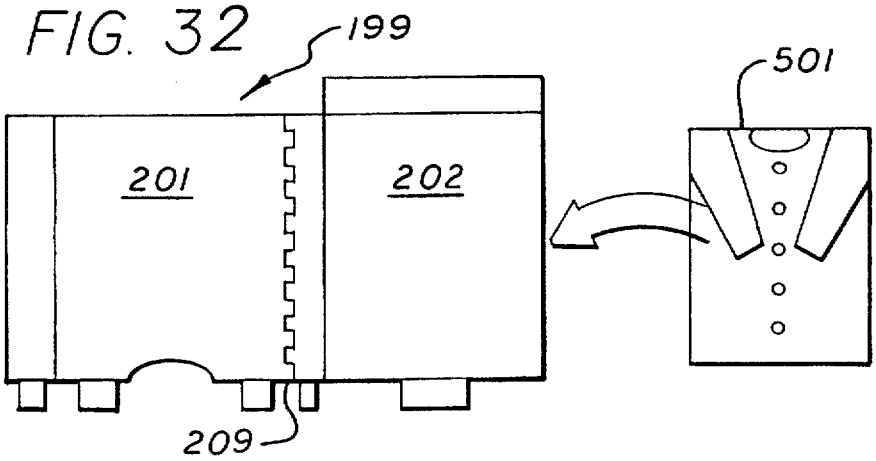

FIG. 33a
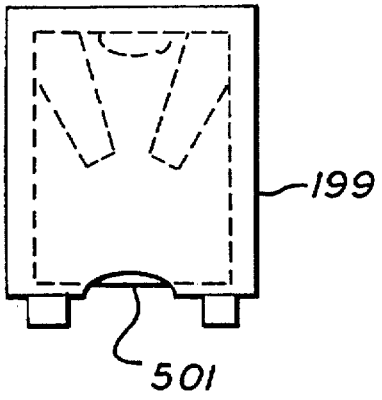
FIG. 33b
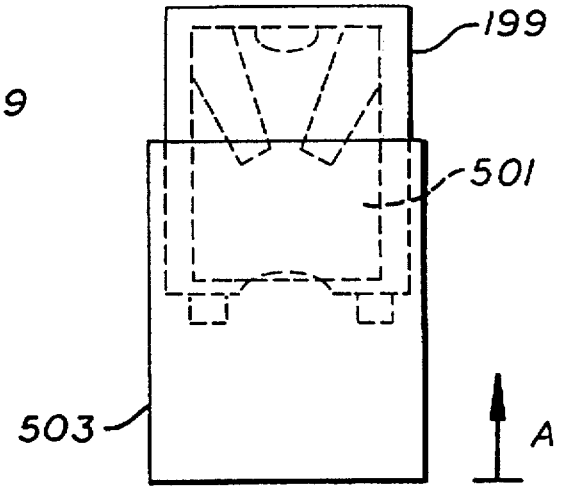
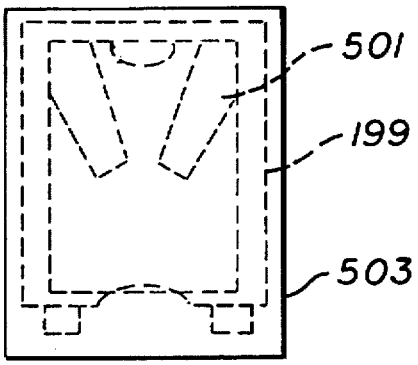
FIG. 33c
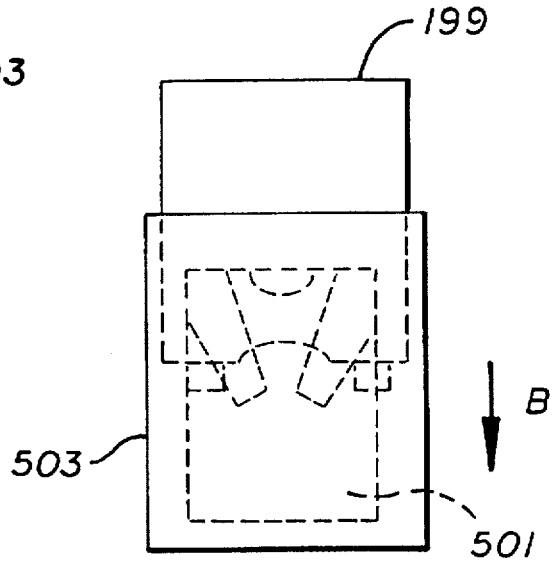
FIG. 33d

FIG. 35a
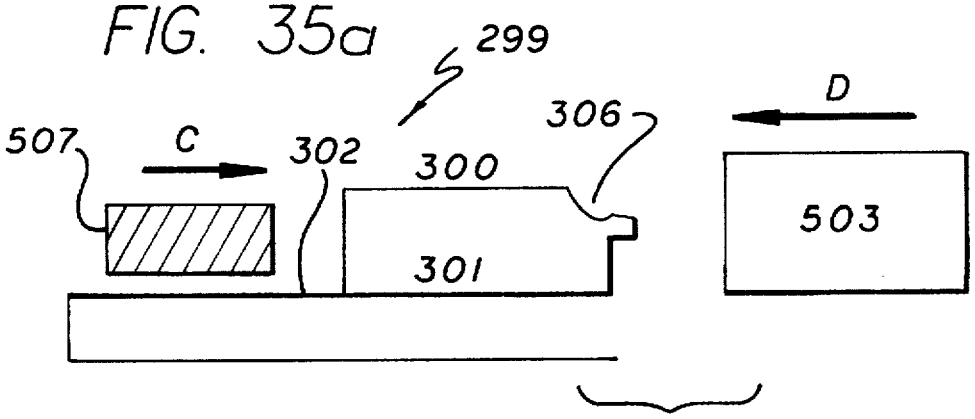
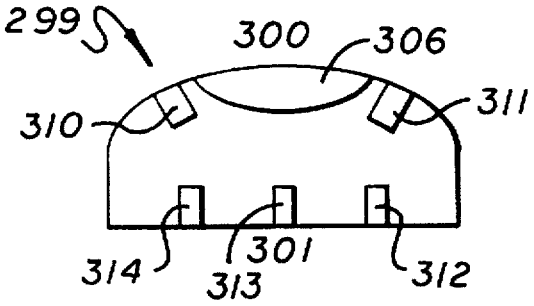
FIG. 35b
FIG. 35c
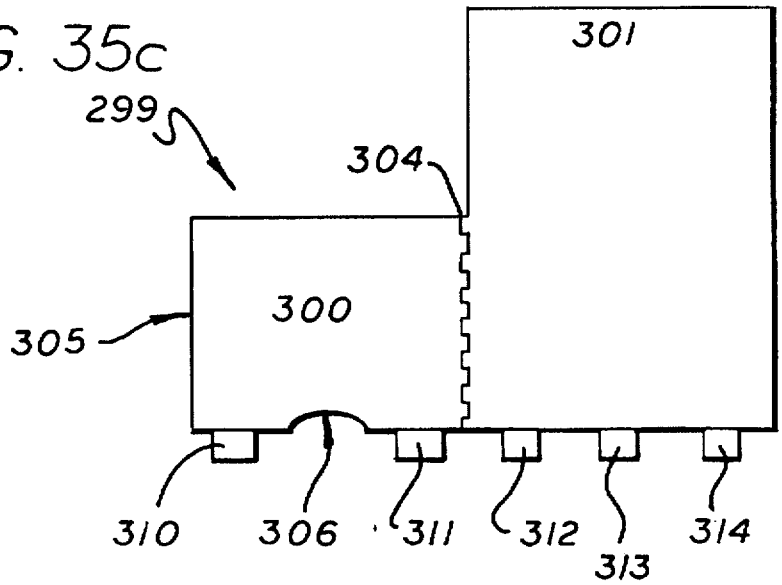

PRE-WRAPPED GIFT PACKAGE

CROSS REFERENCE TO RELATED APPLICATIONS

This is a continuation in part of application Ser. No. 07/933,493 filed Aug. 21, 1992 now U.S. Pat. No. 5,245,815.

BACKGROUND OF THE OF THE INVENTION

1. Field of the Invention

The present invention relates generally to the field of gift wrapped packages and in particular to a pre-wrapped gift box which, when assembled, has the appearance of a hand wrapped gift package.

2. Description of the Prior Art

The gift wrapping of packages is a reoccurring event which is often a time consuming and frustrating experience. It is difficult, without considerable experience, to properly estimate and accurately cut the correct amount and shape of wrapping paper needed. It is also difficult to tightly and neatly attach the paper to the box. To avoid these problems of hand wrapping packages, a gift wrapping service may be employed, however, this is a relatively expensive alternative.

Pre-wrapped gift packaging is presently known, but its pre-wrapped nature is obvious. That is, the gift receiver may easily tell that the gift was not individually, gift wrapped. For example, packages are commercially available consisting of a pre-wrapped open box bottom and a pre-wrapped box cover. Also, packages with printed external surfaces are presently sold, in theory, eliminating the need for separate wrapping. Similarly, boxes with decorative wrapping paper loosely attached are known.

But the giving of gifts in packages which are clearly and noticeably not hand wrapped may convey a lack of caring or consideration. This is opposite to the sentiment normally sought to be conveyed by the giving of a gift. What is needed is a pre-wrapped gift package which, when assembled, provides the pleasing appearance of a hand wrapped gift wrapped box and which maintains this appearance after being opened.

It is also desirable that the pre-wrapped gift package assembly incorporate a volume sizer of some sort, so that the purchaser can simply, and without measuring, determine by comparison with the intended gift if the assembled package is the proper size for the gift. This would be particularly useful if several different sizes of the pre-wrapped gift package were on sale at the same retail outlet.

The use of pre-wrapped boxes in apparel sizes, ie. 15"×10"×2", 10"×7"×2", etc. poses specific problems due to the narrow dimension in which the gift, to be wrapped, must be introduced into the box cylinder. The tendency of the gift is to bundle and/or catch on the box flaps causing considerable difficulty for insertion of the gift with ease and speed. In addition, the gift being inserted is normally wrapped with tissue paper for aesthetics. The tissue paper will normally catch on the box flaps and tear becoming unattractive. Furthermore, many times gifts somewhat larger than normal are inserted into the box causing an even more difficult time of gift insertion.

SUMMARY OF THE INVENTION

The preceding and other shortcomings of the prior art are addressed and overcome by the present invention which provides, in a first aspect, a method of making a pre-wrapped box by forming a sheet of thin, generally rectangular box construction material into a tube shape having two opposing joint sides and two opposing flap sides, each flap side having a flap crease and a pair of major end flaps alternating with a pair of minor end flaps extending from that flap crease, the major end flaps extending substantially further from the flap crease than the minor end flaps, the sheet including folding creases extending across the flap creases and between each of the alternating pairs of end flaps, the end flaps being sized so that each set of the pairs of major and minor end flaps extending from each said flap crease are closable to form the end portions of a box when the folding creases are in a folded condition and the opposing joint sides are joined to form said sheet into a box, affixing a sheet of decorative paper to one surface of the sheet of construction material at each of the minor flaps, the paper extending across at least a portion of the surface of each major end flap, and folding at two of the folding creases and joining the joint sides to form a flattened box tube which may then be further folded to form a wrapped box.

In another aspect the invention provides a method of enclosing an article in a wrapped box by forming a sheet of thin, generally rectangular box construction material into a shape having two opposing joint sides and two opposing flap sides, each flap side having a flap crease and a pair of major end flaps alternating with a pair of minor end flaps extending from that flap crease, the major end flaps extending substantially further from the flap crease than the minor end flaps, the sheet including folding creases extending across the flap creases and between each of the alternating pairs of end flaps, the end flaps being sized so that each set of the pairs of major and minor end flaps extending from each said flap crease are closable to form the end portions of a box when the folding creases are in a folded condition and the opposing joint sides are joined to form said sheet into a box, affixing a sheet of decorative paper to one surface of the sheet of construction material at each of the minor flaps, the paper extending across a portion of the surface of each major end flap, folding at least two of the folding creases, joining the joint sides to form a flattened box tube, folding the remaining creases to form an open box tube shape, folding one pair of the major end flaps to close one end of the box tube, folding the corresponding minor end flaps and a portion of the wrapping paper affixed to the minor end flaps over the major end flaps, thereby causing a portion of the wrapping paper formerly covering a portion of each major end flap to assume a folded shape, creasing the folds of the folded portions of the wrapping paper to form a pair of opposing wrapping paper flaps, folding the opposing wrapping paper flaps over the end flaps to overlap one another, affixing the overlapping wrapping paper flaps together to close one end of a wrapped box, inserting an article in the box, and closing the other end of the box by performing a similar series of operations with the other pair of end flaps to form a wrapped box enclosing the article.

In still another aspect, the present invention provides a pre-wrapped gift box kit including a pre-formed sheet of thin, generally rectangular box construction material having two opposing joint sides and two opposing flap sides, each flap side having a flap crease and a pair of major end flaps alternating with a pair of minor end flaps extending from that flap crease, the major end flaps extending substantially further from the flap crease than the minor end flaps, the sheet including folding creases extending across the flap creases and between each of the alternating pairs of end flaps, the end flaps being sized so that each set of the pairs of major and minor end flaps extending from each said flap crease are closable to form the end portions of a box when the folding creases are in a folded condition and the opposing joint sides are joined to form said sheet into a box, and a sheet of decorative paper affixed to one surface of the sheet of construction material at each of the minor flaps, the paper extending across a distance greater than or equal to one half the width of the minor flap and less than or equal to one half the width of a major flap, means for joining the joint sides, and means for securing together folded paper flaps formed by the folding of the minor flaps over the major flaps when the combined sheets are formed into a box. The affixed sheets of construction material and paper may be formed in the shape of a flattened box tube and packaged with a flattened pull bow to form a flat, easy to handle gift decorating kit.

In still another aspect, the present invention includes a volume sizer, a mechanism by which a prospective purchaser could easily visualize the volume that would be available in the pre-wrapped gift box when assembled in order to determine if an object, such as a gift, would fit within the pre-wrapped package of the present invention. The volume sizer is in the form of a flattened box structure attached to the main body of the assembly. When the flattened box structure is erected it forms an open box having the same volume as the pre-wrapped package.

The after assembly volume sizer includes a generally rectangular sheet of box construction material from which an open box is formed. The sheet is creased twice along its width in order to facilitate its being folded into an open box. The folding creases divide the sheet into three generally rectangular sections: a first side section, a central section, and a second side section.

The flattened box structure is formed by folding the first side section underneath the central section. The folded sheet is removably joined to the outside of the plastic wrap enclosing the pre-wrapped package at the outer edges of the first and second side sections.

Alternatively, the volume sizer may be erected from a sheet creased in an accordion-like fashion and attached only to the face of the pre-wrapped gift box package. As in the already described embodiment, the volume sizer consists of a rectangular sheet of box construction material creased twice along its width resulting in three major sections: a first side section, a central section, and a second side section. In this embodiment both side sections are also creased along their widths such that each side section is comprised of two subsections separated by a minor crease.

The flattened box structure is formed by simultaneously folding the first and second sides' minor creases inward toward each other. This results in the central section collapsing down upon the folded first and second side sections. The folded box structure is removably joined to the outside of the plastic wrap, enclosing the pre-wrapped gift box package, at the outer edges of the first and second side sections.

A prospective purchaser erects the volume sizer to form an open box with the same volume as the pre-wrapped package. An item to be packaged may then be placed within the open box of the volume sizer to determine if that item will fit within the pre-wrapped package.

As an alternative embodiment, once assembled, the volume sizer may be made detachable. This allows the seller of the gift wrapping package kit to replace dirty or damaged volume sizers as necessary.

In still another aspect, a removable greeting or gift card, and/or a removable envelope for the card, are included in the volume sizer. The greeting card and envelope are removable from the remainder of the volume sizer by means of perforated borders to allow for easy detachment.

In yet another aspect, this invention includes an inner sleeve which is used to more easily place a gift inside a partially assembled pre-wrapped gift box. This inner sleeve may be packaged inside of and as a separate item within the pre-wrapped gift box package, or, alternatively, the volume sizer may be used as the inner sleeve. Where it may be difficult to place the gift inside a partially constructed pre-wrapped gift box, the inner sleeve is placed around the gift such that the inner sleeve enclosed gift can then be easily placed within a partially constructed pre-wrapped gift box. The inner sleeve may then be pulled from the inside of the pre-wrapped gift box before it is closed, or it may be left inside.

In another aspect, the present invention provides a method for loading a gift into a gift box forming and erecting a gift box tube having open ends, inserting a gift into a cantilevered cylinder of a box loader, said cylinder having a convex top or bottom and being shaped for insertion into the gift box tube, sliding the gift box tube onto the cylinder, compressing the gift box tube and gift to withdraw the box tube enclosing the gift from the box loader, and forming the gift box tube into a gift box with the gift inside.

In yet another aspect, the present invention provides a box loader for use in placing a gift in a gift box with a gift chamber having a convex top or bottom and being cantilever supported from a first end, means for inserting a gift into the gift chamber, means for sliding a gift box tube onto the gift box chamber, means for removing the gift box tube and gift from the chamber, and means for forming the gift box tube into a gift box including the gift.

The preceding and other shortcomings of the prior art are addressed and overcome by the present invention which provides, in a first aspect, a method of forming common materials, ie. metal, plastic, etc., into sleeves which either represent the general dimensions of the box to be used or an oval or similar shape of the box when the box is intentionally distorted.

The sleeve consists of, in a first aspect, a bottom, two or three sides and a flat or convected top. The combined dimensions of the bottom, sides, and top of the sleeve form the general dimensions of the pre-wrapped box in which it is to be inserted. One or both ends of the sleeve remain open with a series of guide flaps being attached to the bottom, sides, and top of one of the open ends. These guide flaps are angled downward to form a funnel effect smaller than the open end dimension formed by the bottom, sides, and top of the sleeve. The sleeve top is attached to one side by means of a hinge of similar apparatus allowing the top to be lifted up and away. This allows the inside portion of the sleeve to be exposed for use during gift and/or tissue preparation. The top, at the guide flap end, has a shaped portion removed to form an area in which fingertips may easily be introduced into the area inside the sleeve.

The sleeve bottom, at the non-guide flap end, may extend by means of additional material beyond the actual dimension of the sleeve. This portion may be less than, equal to, or greater than two times the length of the pre-wrapped box minor flap. However, it is not necessary for this portion to exist for the sleeve to function effectively.

In a second aspect, the sleeve consists of material that is formed into an oval or similar shape slightly less than the dimensions of a particular pre-wrapped box when distorted into an oval or similar shape. The sleeve is funneled at one end by means of guide flaps attached at points around the sleeve or by forming the sleeve material to created a funnel effect. At the non-flap end of the sleeve a staging area which consists of a bottom and sides exists. This staging area represents the general dimensions of the pre-wrapped box. The staging area is used to fold the gift and/or tissue before being slid into the sleeve.

This sleeve can be greater than or equal to the length of the pre-wrapped gift box. Both ends are open.

In each aspect, the sleeve at the end of the non-guide flap bottom surface is attached by means of a space bar and attachment mechanism to a flat plate material or to the wrapping surface, ie. the store counter, so as to allow the sleeve to suspend above the plate or wrapping surface allowing the pre-wrapped box bottom to slide under the sleeve. This allows ease of box or sleeve insertion. The sleeve may also have a roller system allowing it to slide into the pre-wrapped box. Also, the sleeve can exist on its own and can be slid into the box independent of any suspension mechanism.

In each aspect the sleeve is either inserted into the pre-wrapped gift box or the pre-wrapped gift box is slid over the sleeve. After this occurs the pre-wrapped box along with the gift in the sleeve is removed from the sleeve with speed and ease.

These and other features and advantages of this invention will become further apparent from the detailed description that follows, which is accompanied by several drawing figures. In the figures and description, numerals indicate the various features of the invention, like numerals referring to like features throughout both the drawings and the description.

BRIEF DESCRIPTION OF THE DRAWINGS

FIG. 1 is a top plan view of a partially assembled box tube including a flat sheet of box construction material, cut and creased for folding, overlying a flat sheet of gift wrapping attached thereto in accordance with the present invention.

FIG. 2 is a top plan view of the attached sheets of box construction material and wrapping paper shown in FIG. 1 which have been rotated to show the wrapping paper on top.

FIG. 3 is an isometric view of a pre-wrapped package formed from a box tube with end flaps on one end in the open position.

FIG. 4 is the pre-wrapped package shown in FIG. 3 after the end flaps have been folded and folded end portions of the wrapping paper have been creased.

FIG. 10 is a top plan view of a partially assembled volume sizer, including a flat sheet of box construction material, cut and creased for folding, with an optional detachable card.

FIG. 11 is a top plan view of the flattened, collapsed volume sizer where part of the sheet has been folded underneath; it is attached to a transparent plastic wrap which surrounds the flattened box tube of FIGS. 5 and 6 in accordance with the present invention.

FIG. 12 shows the part of the sheet which has been folded underneath and attached to the transparent plastic wrap, to which the volume sizer is attached as shown in FIG. 11.

FIG. 13 shows the assembled volume sizer when the sides of the volume sizer are erected, forming an open box having the same volume as the pre-wrapped package of the present invention.

FIG. 14 is a top plan view which shows an alternate placement of the volume sizer, where the lower edge of the folded volume sizer is coincident with the lower edge of the flattened box tube.

FIG. 15 shows the assembled volume sizer of FIG. 14 positioned so that a volume sizing box with five closed sides is created when the sides of the volume sizer are erected, with some outside surface, such as a table top or the floor, serving as one of the five sides.

FIG. 16 is a top plan view of another alternate placement of the volume sizer for a cubical box, where it is aligned with the width of the flattened box tube of FIGS. 5 and 6.

FIG. 17 is a top plan view of still another alternate placement of the volume sizer, where it is aligned with one of the diagonals of the top of the flattened box tube of FIGS. 5 and 6.

FIG. 23 is a separated side view of a flattened, collapsed volume sizer showing the hinges, subsections of the side sections, the center section, and tacking points.

FIGS. 24*a* and 24*b* show side views of an inner sleeve within a pre-wrapped box with both ends open.

FIG. 25 is a top plan view of an inner sleeve with five panels.

FIG. 26 is a top plan view of an inner sleeve with four panels.

FIG. 28 shows the difference in length of the inner sleeve and the pre-wrapped gift box.

FIGS. 29*a–d* show the inner sleeve enclosed gift being placed into the pre-wrapped gift box and the inner sleeve being removed.

FIG. 30 shows the constituent parts of a box loading device.

FIG. 31 shows the difference in upper and lower panels of a box loading device.

FIG. 32 shows the box loading device with an open upper hinged rectangular cylinder.

FIGS. 33*a–d* show the placement of a gift into a box with a box loading device.

FIGS. 34 shows a side view of a box loading device, and an open ended box immediately prior to being slid onto the box loading device.

FIGS. 35*a–c* show a convex box loading device.

DETAILED DESCRIPTION OF THE PREFERRED EMBODIMENT

Figure 5:
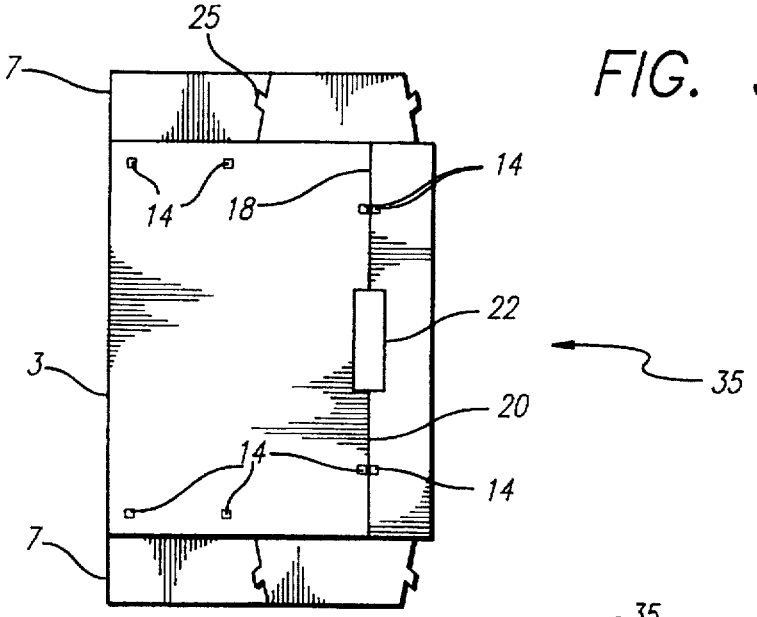
FIG. 5 is a top plan view of the box tube shown in FIGS. 1 and 2 after joining of the joint sides.

The present invention provides an easily formed pre-wrapped package having the pleasing appearance of a hand wrapped box.

Referring to FIGS. 1 and 2, a presently preferred embodiment of the invention includes a generally rectangular sheet 1 of box construction material overlying a piece of wrapping paper 3 affixed thereto. Sheet 1 may be a die cut and creased piece of cardboard or other similarly formed thin sheet of material suitable for gift box construction. Sheet 1 is formed to have body 5, four major end flaps 7 and four minor end flaps 9. Two major end flaps 7 and two minor end flaps 9 are alternately located along each long or flap side of body 5, like sized end flaps opposing each other.

Sheet 1 is creased in several places to facilitate its being folded into a closed box. Horizontal or flap creases define the juncture of body 5 with end flaps 7 and 9 and are the lines along which end flaps 7 and 9 are to be folded. Inner edge 10 of minor end flap 9, for example, lies along horizontal crease 11. Vertical or folding creases 13 form the lines along which body 5 is to be folded and define the width of the sides of the box to be formed.

Each minor end flap 9 is slightly narrower at its outer edge 8, than its crease edge 10, to leave room for the creased wrapper paper in order to produce a cleanly wrapped package that is clearly individually, hand wrapped. For convenience of the description herein, the width of each flap will be considered to be its width along horizontal crease 11, e.g. crease edge 10, while the extension of each flap will be the distance from the edge of the flap along the horizontal crease to the flap outer edge, such as outer edge 8. As noted below, if the assembled gift box is to be square-in shape, the widths of all major and minor end flaps 7 and 9 will be approximately the same. The extensions of such flaps will be different as described herein below.

End tab 15 is utilized to form a lap joint with the opposite end of body 5 to hold folded body 5 together when the vertical crease 13 adjacent end tab 15 is folded. The joint may be formed by adhesive material positioned, for example, along tacking strip 16 at the outer edge of end tab 15.

Wrapping paper 3 is affixed to folded body 5 at many points, such as tacking points 14, each of which may be formed by crimping wrapping paper 3 to folded body 5, or by providing a drop of adhesive between wrapping paper 3 and folded body 5, or by any other convenient mechanism which results in the handling and appearance of a hand wrapped box when that box is unwrapped. Rubber cement or other suitable bonding material may be used. In particular, using tacking points between the paper and the box which readily come apart during unwrapping provides a more hand wrapped appearance than a technique, such as surface taping, which would attach the surface of wrapping paper 3 not in contact with folded body 5 to folded body 5. Surface taping between minor end flaps 9 and the edge of wrapping paper 3 adjacent thereto, for example, interferes with unwrapping and imparts the appearance and feel of a non-hand-wrapped package.

Tacking points 14 are positioned as indicated along the inner edges 12 of minor flaps 9 at the intersection thereof with the outer edge 8 of each such flap. Wrapping paper 3 must be adhered along its inner edges 12 to minor end flaps 9 to insure paper flaps 17, as shown in FIG. 4, are properly formed when minor end flaps 9 are folded, as described below. Additional tacking points 14 may be provided wherever convenient or desired for any particular application, except that each major end flap 7 must not be affixed to the portion of wrapping paper 3 adjacent thereto. In addition, it may be convenient to provide tacking points 14 along wrapping paper seam edges 18 and 20, as shown for example in FIG. 2, to form a seam therebetween.

In addition to tacking points 14 along wrapping paper seam edges 18 and 20, or as an alternate thereto, a small piece of tape, such as tape segment 22, may be used to form the seam. Tape segment 22 may conveniently be used to form the seam between edges 18 and 20 because, during unwrapping, a piece of tape along the paper seam is a normal result of hand wrapping. Tape segment 22 is shown in FIGS. 1, and 2 as attached to first to seam edge 18, for convenience. As shown most clearly in FIGS. 2 and 3, wrapping paper 3 may be affixed to folded body 5 so that the seam formed by joining wrapping paper seam edges 18 and 20 is conveniently positioned along the side of box 19 including major end flaps 7. In this way, when assembled, the seam interferes only minimally with the construction of the box. The seam may also be positioned along the side of the box including a minor flap, but additional tacking points 14 may then be required and the seam may interfere with wrapping paper flaps 17, as shown in FIG. 4.

The relative sizes of major and minor end flaps 7 and 9, and the relationship of the size of wrapping paper 3 with respect thereto, depends on the desired shape of the final box. The box formed from the configurations shown in FIGS. 1, 2, 5 and 6 will be generally rectangular in cross-sectional shape. That is, the shape of the flap end of the box when assembled will be rectangular. The box shown being formed in FIGS. 3 and 4 is generally square in cross-sectional shape.

With regard first to a rectangular box, as shown for example in FIGS. 1, 2, 5 and 6, the extension of each major flap must be no greater than the width of each minor flap 9 so that the major flaps may be folded over each other, each substantially filling the open area formed at each end of box tube 35 during assembly. Although the extension of the major flaps may be shorter than the width of minor flaps, it is desirable for them to be substantially equal to the width of the minor flaps so that each such major flap fills the open end of the box tube 35 when assembled to provide maximum rigidity unless an interlocking or mating flap configuration is used as described below in greater detail. If the extension of the major flap were greater than the width of minor flap, the major flap would be too long to fold into the box tube end opening.

On the other hand, the extension of each minor flap should be no greater than one half the width of each major flap so that when the minor flaps are folded over the folded major flaps, the end of each minor flap will just meet the end of other minor flap to form a butt joint. If the extension of the minor flaps exceeds one half the width of the major flaps, the minor flaps will overlap each other when the box is assembled. This overlapped condition may be noticeable through the paper covering and is therefore usually undesirable unless required for a particular box application. Although the minor flaps may be completely eliminated, the assembled box will be stronger and will more closely resemble a hand wrapped box when unwrapped if the extension of the minor flaps is only slightly less than one half the width of the major flaps.

The length of wrapping paper 3 is simply equal to or slightly longer than the sum of the widths of the pairs of minor and major flaps. If the length of wrapping paper 3 is longer than this sum, the seam between wrapping paper seam edges 18 and 20 becomes an overlapping seam with one such edge overlapping the other. An overlapping seam is consistent with hand wrapping techniques. The required width of the paper, for a rectangular box, is related to the size of the box as follows. Wrapping paper 3 must be wide enough to extend past each horizontal crease 11, along each major end flap 7, a distance equal to at least one half of the width of the minor flap. It is preferable that the paper does not extend past each horizontal crease 11 more than a distance equal to half the width of the major flaps so that wrapping paper flaps 17, described below, may be made neatly without unnecessary overlapping of folded paper.

With regard now to a square box, the width of the major and minor flaps are equal because of the square shape of the box. The extension of each major flap must therefore be no greater than its width while the extension of each minor flap must be no greater than one half its width. Wrapping paper 3 must be wide enough to extend past each horizontal crease 11, along each major end flap 7, a distance equal to one half of the width of the minor flap.

Referring additionally now to FIGS. 3 through 6, sheet is folded along creases 13 forming a box tube 35 having two pair of opposing surfaces. End tab 15 along one joint side of body 5 is adhered to the opposite end of body 5 to fix sheet 1 in the box tube shape. Sheet 1 may be alternatively fixed in its tubular shape by omitting end tab 15 and applying tape along the end portions of the joint sides of body 5, while they are being held closely together, to form a butt joint.

Figure 6:
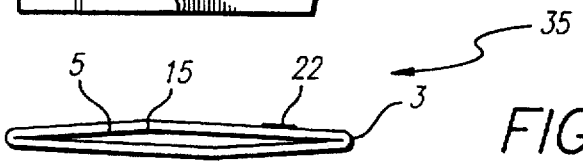
FIG. 6 is an end view of the flattened box tube of FIG. 5.

In either event, after end tab 15 is secured to the opposite edge of folded body 5, or a butt joint is formed in folded body 5, folded body 5 may conveniently be refolded flat along a pair of vertical creases 13 which preferably do not include the joint sides of folded body 5 as shown for example in FIGS. 5 and 6. In this folded flat condition, slightly exaggerated in the end view shown in FIG. 6 for ease of illustration, the pre-wrapped gift box assembly of the present invention may conveniently be inserted into a transparent plastic bag and header assembly and shipped, displayed and sold in a conventional hanging retail sales configuration.

To form the assembly shown in FIGS. 5 and 6 into a wrapped gift box, the remaining vertical creases 13 are folded to form an open box tube as shown in FIG. 3. Major end flaps 7 are then folded, one at a time, into the opening of box tube 35 to form one end of box 19. After major end flaps 7 have been folded into the tube formed by folded body 5, minor end flaps 9 are folded inward to rest on the surface formed by folded major end flaps 7. Wrapping paper flaps 17, as shown in FIG. 4, are formed by the folding of minor end flaps 9. Wrapping paper flaps 17 are creased, folded together and taped, completing the formation of the pre-wrapped package. In an alternate embodiment, wrapping paper 3 may be precreased along precrease lines 30 as shown in FIG. 2.

Tape segment 32 may conveniently be preattached to one such wrapping paper flap 17 as shown in FIG. 6 between precrease lines 30 so that completion of each side of the gift box is accomplished by taping tape segment 32 on one wrapping paper flap 17 directly to the top or display surface of the mating wrapping paper flap 17. After one side of box 19 has been formed from box tube 35 by folding and taping, the gift or other object may be inserted in box 19 which is then closed by folding and taping the open end of the box tube in the same manner. When completed, box 19 has the appearance of a gift wrapped package, indistinguishable from boxes separately wrapped with gift paper. When box 19 is opened, the separate or fully hand wrapped, paper gift wrapped appearance of box 19 is maintained.

Although one major flap may simply be folded in on the next major flap, there is a substantial advantage in rigidity and strength of the resulting box 19 to use interlocking major end flaps as shown in FIGS. 1, 2, and 3. Referring now again to FIG. 1, each pair of major end flaps 7 forming one end of box 19 may be made to interlock with each other. In particular, one such major flap may be fitted with extension tabs 25 while the other major flap includes mating tab slots 27. When box 19 is being assembled from flattened tube 35, as shown in FIG. 5 and 6, the major end flap 7 including mating tab slots 27 is folded first. Then the other major end flap, which includes extension tabs 25, is folded thereover. Extension tabs 25 are then inserted in mating tab slots 27 interlocking the major flaps together.

Tabs 25 and slots 27 are the presently preferred means of interlocking the major end flaps in this embodiment of the invention, but other male/female interlocking configurations may be utilized.

Approximate relative dimensions for an exemplar of sheet 1, which may be utilized to form boxes incorporating principles of the present invention, is shown below in Chart 1.

CHART 1

| Box Size | Body | Minor Flaps | Major Flaps | End Tab |
|---|---|---|---|---|
| 6 × 4 × 4 | 6 × 16 | 2 × 4 | 4 × 4 | 6 × 0.75 |
| 7 × 7 × 7 | 7 × 24 | 3.5 × 7 | 7 × 7 | 7 × 0.75 |
| 8 × 8 × 4 | 8 × 24 | 2 × 4 | 4 × 8 | 8 × 0.75 |
| 9 × 4 × 4 | 9 × 16 | 2 × 4 | 4 × 4 | 9 × 0.75 |
| 9 × 9 × 5.5 | 9 × 29 | 2.75 × 5.5 | 5.5 × 9 | 9 × 0.75 |
| 12 × 6 × 6 | 12 × 24 | 3 × 6 | 6 × 6 | 12 × 0.75 |

Figure 7:
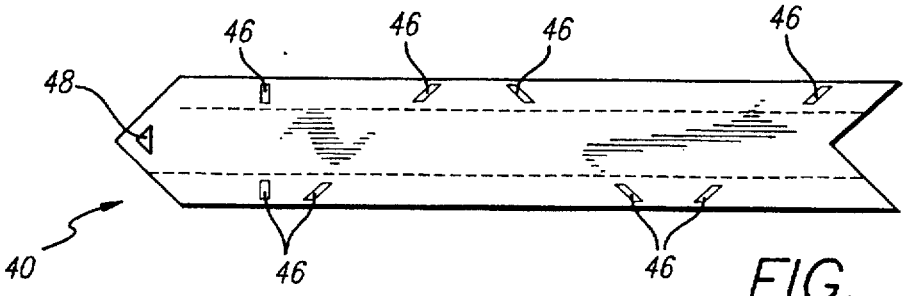
FIG. 7 is a top plan view of a conventional pull bow to be packaged with the flattened box tube of FIGS. 5 and 6 according to the present invention.
Figure 8:
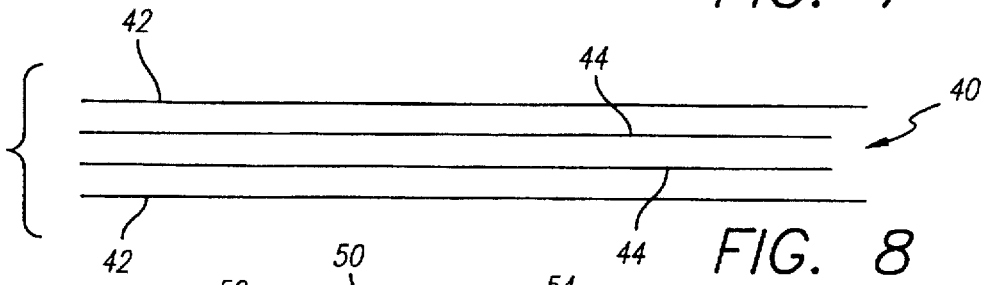
FIG. 8 is an exploded side view of the pull bow of FIG. 7.

The flattened box tube 35 shown in FIGS. 5 and 6 may conveniently by packaged, shipped and displayed in the flattened condition as shown. It is advantageous to provide a ribbon and bow arrangement compatible therewith for use in completing the assembly of box 19 in the same flattened package. Referring now to FIGS. 7 and 8, a ribbon and bow arrangement is the pull bow, such as pull bow 40. Various types of pull bows are known, such as the series of pull bows available from 3M Packaging Systems Division, St. Paul, Minn. A pull bow may be shipped in the flattened condition shown for example in FIG. 7 and conveniently extended into a puffy bow and ribbon arrangement at the time as assembly of box 19.

Figure 9:
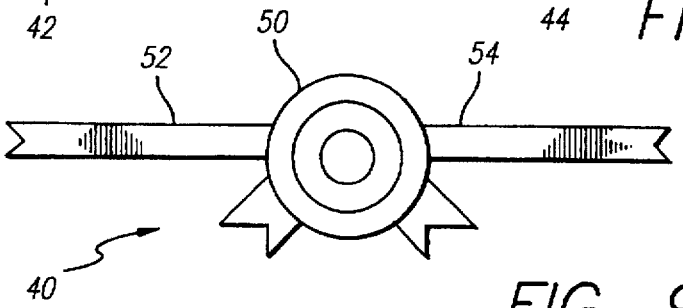
FIG. 9 is a top plan view of the pull bow of FIGS. 7 and 8 after being pulled to form a bow and ribbon arrangement.
Figure 19:
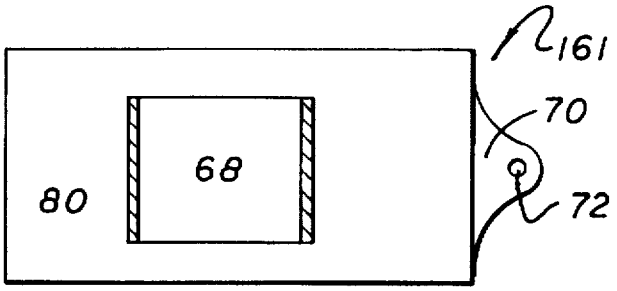
FIG. 19 is a top plan view of a flattened, collapsed volume sizer attached to the transparent plastic wrap which surrounds the flattened box tube of FIGS. 5 and 6.

The exemplar pull bow shown in FIGS. 7 and 8 includes outer ribbon pair 42 surrounding inner ribbon pair 44. Outer ribbon pair 42 is in the form of a hollow tube surrounding inner ribbon pair 44 and held together by a series of tacking points 46 spaced apart from inner ribbon pair 44. In addition, end tacking point 48 is provided which affixes one end of outer ribbon pair 42 to the end of inner ribbon pair 44. The pattern of tacking points 46 through outer ribbon pair 42 and the exact shapes of the ribbon pairs, determines the appearance of the bow, such as decorative bow 50 shown in FIG. 9, formed when inner ribbon pair 44 pulled out of the sheath formed by outer ribbon pair 42. Inner ribbon pair 44 when pulled out of the sheath form package ribbons 52 and 54 which are then conveniently used to secure decorative bow 50 to box 19 to complete the assembly. The required length for package ribbons 52 and 54 depends on both the size and dimensions of box 19 when assembled as well as the way in which the ribbon is positioned around the box. The dimensions for the components of pull bow 40 for various box sizes and ribbon arrangements are well known and may easily be determined.

Pull bow 40 may therefore be combined in a convenient package with box tube 35, as well as segments of tape to form tape segments 22 and 32, to form a gift package wrapping kit which may therefore be packaged in a flat condition for shipping, distribution, storage, and display for retail sale. The kit may be enclosed by a clear plastic wrap in order to protect it while in the store.

The present invention further includes a flattened, collapsed box attached to the exterior of the clear plastic wrap 80 which encloses the main body of the assembly. When the sides of the flattened, collapsed box are erected, it forms an open box having the same volume as the gift box assembled from the flattened box tube 35, as shown in FIGS. 5 and 6. The open box functions as a volume sizer 61, that is, it enables a prospective purchaser of the gift package wrapping kit to determine if the gift box is the proper size to contain the item that he wishes to box by comparing the item with the open box.

Referring to FIG. 10, a preferred embodiment of the invention includes a generally rectangular sheet 60 of box construction material from which an open box which serves as the volume sizer 61 is formed. Sheet 60 may be a die cut and creased piece of cardboard or other similarly formed thin sheet of material suitable for box construction. Sheet 60 is creased along lines 62, 63, 64 and 65 to facilitate its being folded into an open box. Folding creases 62, 63, 64 and 65 form the lines along which sheet 60 is to be folded and define the lengths of the sides of the box to be formed. The folding creases divide sheet 60 into five sections: a first hinge section 66, a first box side section 67, a central section 68, a second box side section 69, and a second hinge section 70.

In an alternative embodiment, a removable greeting card 73 and a removable envelope 74 for the greeting card are part of sheet 60. Greeting card 73 and envelope 74 are connected to the remainder of sheet 60 by means of perforated detachable borders 76 and 78 respectively. The placement of the greeting card and envelope on sheet 60 which is shown in FIG. 10 is only one of many possible ways of positioning them on the sheet.

Envelope 74 consists of a generally rectangular body **75*a* and flaps 75*b*, 75*c*, 75*d*, and 75*e*. Once detached from sheet 60, envelope 74 may be assembled by folding flaps 75*c*, 75*d*, and 75*e* across body 75*a*** and securing with adhesive.

The presence of removable greeting card 73 and removable envelope 74 will not be indicated in subsequent drawings in order to obtain greater clarity.

Referring in addition to FIGS. 11 through 12, first hinge section 66 is affixed to the exterior of the plastic wrap 80 along segment 81. Second hinge section 70 is affixed to the exterior of the plastic wrap 80 along segment 82. Segments 80 and 81 can be on opposites sides of box tube 35, and in FIG. 11 second hinge section 70 is affixed to segment 81 on the back side of flattened box tube 35. These attachments are made by means of adhesives. Rubber cement or other suitable bonding material may be used. A folded sheet 84 is formed by folding first box side section 67 along crease 63 so that it is underneath central section 68.

For clarity of presentation of the other elements of the figures, the presence of plastic wrap 80 is indicated explicitly only in FIG. 11 and the only parts of sheet 60 shown on FIG. 12 are first hinge section 66 and first box side 67.

In addition, there is a single tacking point 86 on the exterior of the plastic wrap 80. A corresponding point 88 on the first box side section 67 is attached to tacking point 86 by a drop of a lightly bonding adhesive. Alternatively, small pieces of VELCRO at tacking point 86 and the corresponding point 88 on the first box side section 67 could be used instead. Either arrangement allows the attachment at this tacking point to be easily broken and reaffixed, thereby permitting the volume sizer 61 to be either extended or folded and reattached in the manner herein described.

Referring in addition to FIG. 13, the second box side section 69 may be extended until it is perpendicular to the flattened box tube 35 by folding along creases 64 and 65 and breaking the attachment at the tacking point 86. This also extends the first box side section 67 until it is also perpendicular to the flattened box tube 35. In this way, as shown in FIG. 13, an open box 90 with two parallel, open sides is formed, with part of the flattened box tube 35 forming one of the four closed sides.

The width c of sheet 60, the length b of the central section 68 and the length a of the first and second box side sections 67 and 69 are chosen so that the dimensions of the resulting open box 90, a×b×c, are the same as that of the gift box assembled from the flattened box tube 35, as shown in FIGS. 4 and 5. The open box 90 is then used as a volume sizer 61; that is, a purchaser places an item within the open box 90 to determine whether or not the item would fit within the assembled gift box.

Figure 18:
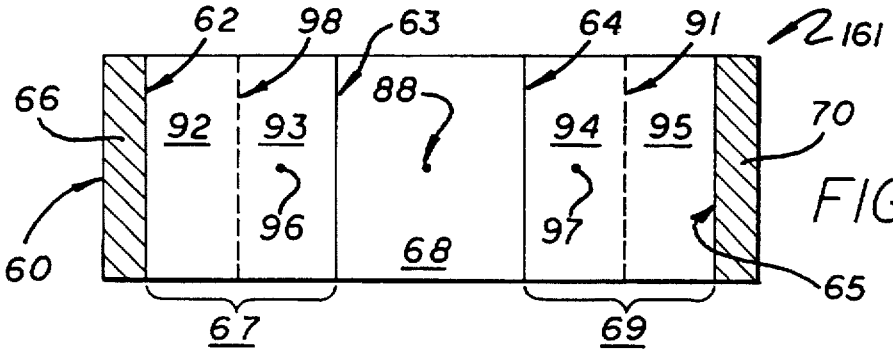
FIG. 18 is a top plan view of a volume sizer: a flat sheet of box construction material creased for folding.

An alternative embodiment of the volume sizer can be seen in FIGS. 18, 19, 20, 21, and 22. FIG. 18 shows a planar view of an alternative volume sizer 161. Like the previously described volume sizer 61, this volume sizer 161 includes a generally rectangular sheet 60 of box construction material from which a volume sizer is formed. Sheet 60 may be a die cut and creased piece of cardboard or other similarly formed material suitable for box construction. Sheet 60 is creased along lines 62, 63, 64, 65, 98, and 91 to facilitate its being erected into an open box tube. The creases define the lengths of the sides of the box to be formed. The creases divide the box sheet 60 into seven sections: a first hinge section 66, a first box side section 67 comprised of first box side subsection alpha 92 and first box side subsection beta 93, a central section 68, and a second box side section comprised of second box side subsection beta 94 and second box side subsection alpha 95, and a second hinge section 70.

Figure 21:
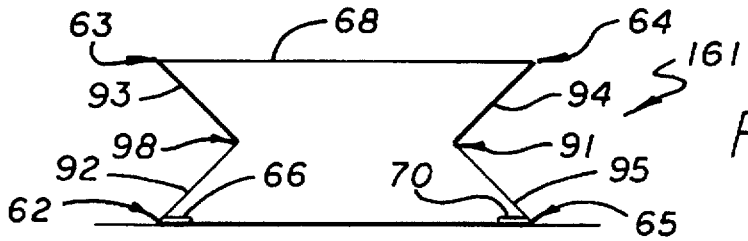
FIG. 21 is a side view of a partially erected volume sizer showing how the side sections fold along the minor creases.
Figure 20:
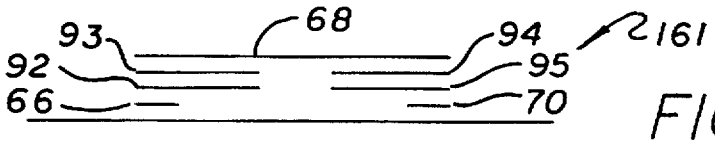
FIG. 20 is a separated side view of a flattened, collapsed volume sizer showing the hinges, subsections of the side sections, and the center section.
Figure 27A:
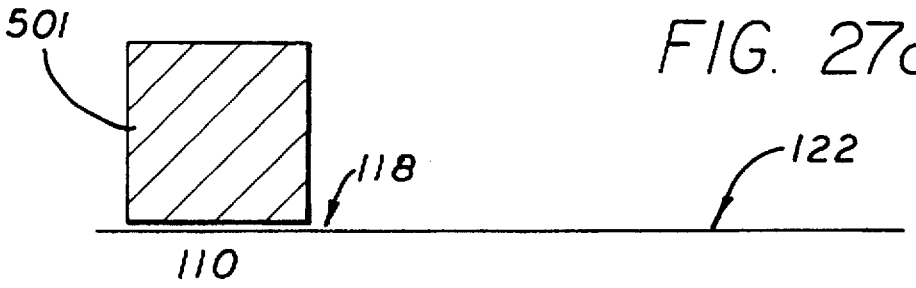
FIGS. 27*a–d* show the enclosure of a gift by an inner sleeve.
Figure 27B:
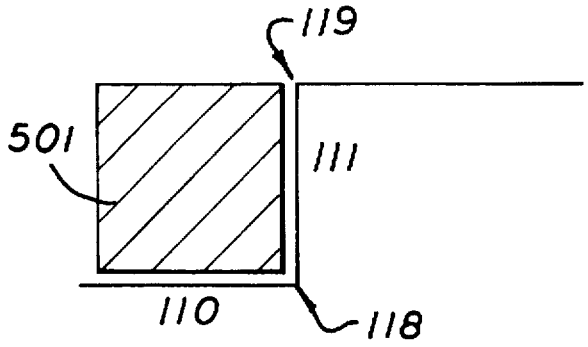
Figure 27C:
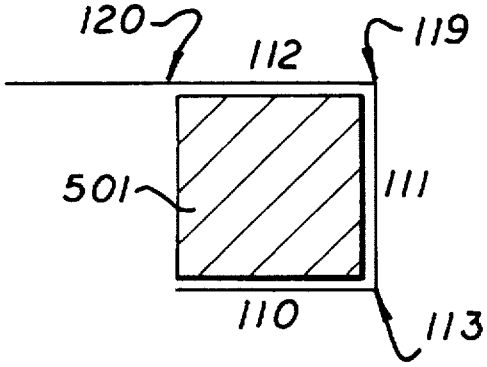
Figure 27D:
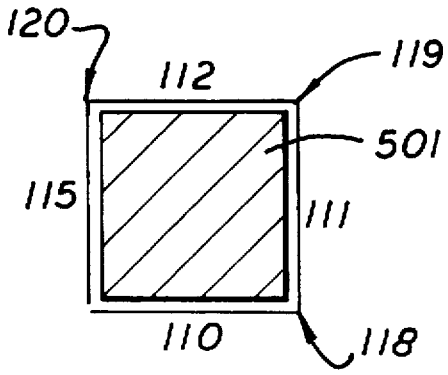

A difference between this volume sizer 161 and the one already mentioned is that the side box sections are creased such that each side box section is comprised of two subsections designated alpha and beta. Referring to FIGS. 20, 21, and 23, when collapsing/flattening the volume sizer 161 each alpha section is folded inward and down such that the beta sections' outer surface is flush with the alpha sections' outer surface when the volume sizer 161 is in its flattened, collapsed state 161. Additionally, when the volume sizer is in its flattened, collapsed state the inner surface of central section 68 is flush with the inner surface of the beta subsections 93 and 94, and the inner surface of the alpha subsections 92 and 95 are flush with the plastic wrap 80 of the pre-wrapped gift package.

Figure 22:
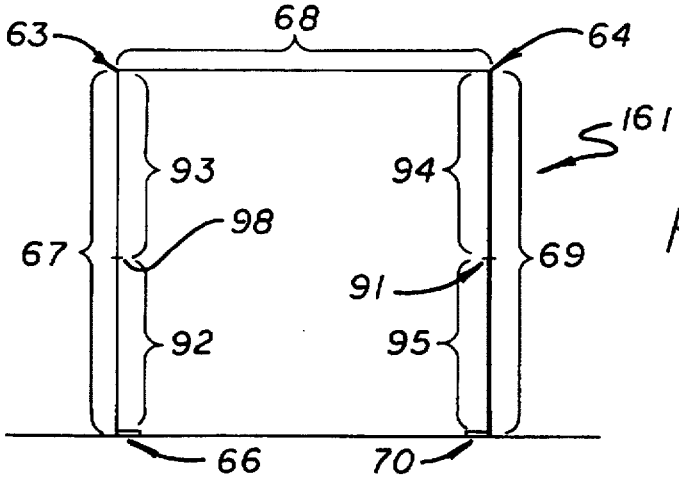
FIG. 22 is a side view of an erected volume sizer showing its constituent parts.

Referring to FIG. 22, in its erected state the volume sizer 161 central section 68 is parallel to the pre-wrapped gift box package, the first and second side sections 67 and 69 are parallel to each other, and the first and second side sections 67 and 69 are perpendicular to both the central section 68 and the pre-wrapped gift box package.

Another difference between this volume sizer 161 and the one already mentioned is that both hinges 66 and 70 are attached to the plastic wrap 80 on the face of the pre-wrapped gift package. Referring to FIG. 21, first and second hinge sections 66 and 70 are affixed to the exterior of the plastic wrap 80. The attachment is made by means of an adhesive such as rubber cement or other suitable bonding material. Alternatively, VELCRO may be used so as to allow for replacement of volume sizers in the event a volume sizer becomes worn.

In addition there may be single or multiple tacking points on the volume sizer 161 shown in FIG. 18. Tacking points 96, 97, 100, 101, 102, 103, 104, 105, 106, 107, 108, and 109 may be used in place of or in conjunction with tacking points 86 and 88. Tacking point 88 on the inner side of central section 68 attaches to a corresponding tacking point 86 on the plastic wrap 80. Tacking points 96 and 97 are located on the outer side of beta subsections 93 and 94 and adhere to corresponding tacking points 100 and 101 located on the outer side of alpha subsections 92 and 95, tacking points 102 and 103 are located on the inner side of alpha subsections 92 and 95 and adhere to corresponding tacking points 104 and 105 on the plastic wrap 80, and tacking points 106 and 107 are on the inner side of central section 68 and adhere to tacking points 108 and 109 on the inner side of beta subsections 93 and 94.

These tacking points utilize a lightly bonding adhesive or VELCRO such that the attachments at the tacking points may be easily broken and reaffixed, thereby permitting the volume sizer 161 to be repeatedly erected and then replaced to its flattened, collapsed state when not being used.

In an alternative embodiment, the volume sizer is made detachable by making the attachments along hinge sections 66 and 70 easy to break and reaffix. This is accomplished by using either VELCRO or a lightly bonding adhesive to make the attachment. The retailer of the gift wrapping package kit would be able to replace dirty or damaged volume sizers as necessary.

The conventional header assembly in FIG. 11, consisting of a header 71 pierced by a circular opening 72 allows the complete gift package wrapping kit to be displayed and sold in a conventional hanging retail sales configuration. The header can be attached to the plastic wrap 80 or it can be part of the volume sizer, as shown in FIG. 16. In the latter configuration, a damaged header assembly 71, is replaceable whenever the volume sizer is replaceable.

A table of approximate relative dimensions for sheet 60, which may be utilized to form volume sizers incorporating principles of the present invention, is shown below in Chart 2. FIG. 10 relates the columns in the chart to the dimensions of sheet 60. The box sizes used below are the same as used in Chart 1.

CHART 2

| Box Size a × b × c | a | b | c | 1 |
|---|---|---|---|---|
| 6 × 4 × 4 | 6 | 4 | 4 | 16 |
| 7 × 7 × 7 | 7 | 7 | 7 | 21 |
| 8 × 8 × 4 | 8 | 8 | 4 | 24 |
| 9 × 4 × 4 | 9 | 4 | 4 | 22 |
| 9 × 9 × 5.5 | 9 | 9 | 5.5 | 27 |
| 12 × 6 × 6 | 12 | 6 | 6 | 30 |

A volume sizer consisting of an open box with two open sides has the disadvantage of requiring that the prospective purchaser of the gift package wrapping kit estimate lengths along the dimension containing the open sides. This could result in the purchase of a gift box which is too small in that dimension to contain the item which the purchaser wanted to be boxed.

FIGS. 14 and 15 show another embodiment of this invention which overcomes this problem. Folded sheet 84 is attached at one of the corners of the flattened box tube 35 in the same manner as described above. Any convenient surface, such as a table top, can then be used as a bottom for open box 90. Open box 90 is functionally equivalent to a six sided box with one open side. The purchaser can more easily place items within open box 90 and more easily determine if the assembled gift box is the correct size.

FIGS. 11 and 14 show the volume sizer in its flattened form as it is stored and shipped. FIGS. 12 and 15 show the volume sizer in its erect form where it may be used to determine if an item will fit within the gift box.

As shown in FIG. 11, for a generally rectangular but not cubical gift box, folded sheet 84 fits on flattened box tube 35 so long as their sides are parallel and the first hinge section 66 is folded over one of the edges of box tube 35. For a generally cubical gift box, however, the length (longest dimension) of the folded sheet 84 can be greater than the width of the flattened box tube 35. As shown in FIG. 16, an alternative embodiment of this invention for a cubical gift box is to hang the length of the folded sheet 84 along the width of the flattened box tube 35 with first hinge section 66 attached to the header 71.

Still another embodiment of this invention is shown in FIG. 17. Here the length of folded sheet 84 is generally 35. parallel to one of the diagonals of flattened box tube Even for a cubical gift box there is no problem with fitting folded sheet 84 on flattened box tube 35.

In yet another aspect, this invention includes an inner sleeve 121 which is used to more easily place a gift 501 inside a partially assembled pre-wrapped gift box 505. This inner sleeve 121 may be packaged inside of and as a separate item within the pre-wrapped gift box package, or, alternatively, the volume sizer 61 may be used as the inner sleeve 121. Referring to FIGS. 25 and 26, the inner sleeve 121 or 122 is a generally rectangular sheet of box construction material 123 which may be formed from a die cut and creased piece or cardboard or other similarly formed suitable material. Inner sleeve 121 is creased in four places, creases 116, 117, 118, and 119, and inner sleeve 122 is creased in three places, creases 118, 119, and 120 resulting in five and four panel inner sleeves respectively.

Alternatively, the inner sleeve 121 crease and size formation may be printed on the inside of a volume sizer such that the volume sizer may be cut and/or creased by the purchaser and used as an inner sleeve. This dual functionality of a volume sizer—inner sleeve reduces cardboard waste.

For the inner sleeve 121 to fit within a pre-wrapped gift box 505, its dimensions must be smaller than those of the pre-wrapped gift box 505. This is shown in FIGS. **24*a* and 24*b* where the inner sleeve 121 and 122 is depicted within a rectangular tube of pre-wrapped gift box dimensions. If the pre-wrapped gift box 505 has length and width dimensions a and b, the inner sleeve 121 must have dimensions a–m and b–n, where m and n are some fraction of an inch such as 0.25 or 0.5 such that there is a space of m/2 and n/2 between the inner sleeve 121 and the pre-wrapped gift box 505. This space is necessary to allow the purchaser to slide the inner sleeve enclosed gift inside the pre-wrapped gift box 505** with ease.

Where it may be difficult to place the gift 501 inside a partially constructed pre-wrapped gift box 505, the inner sleeve 122 is placed around the gift 501 such that the inner sleeve 122 and gift 501 can then be easily placed within the partially constructed pre-wrapped gift box 505. Referring to FIG. 26, the inner sleeve 122 is constructed by the user by folding creases 118, 119, and 120 such that each of the four panels is perpendicular to its immediate neighbor. As shown in FIGS. 27*a–d*, inner sleeve panel 110 is placed on a flat surface with the gift 501 on top of it. Crease 118 should then be folded so that panel 111 is perpendicular to panel 110. Crease 119 should then be folded such that the gift 501 is enclosed by panels 110, 111, and 112; panel 112 should be perpendicular to panel 111, and panel 112 should be parallel to and directly above panel 110 such that the gift is sandwiched between panels 112 and 110. Crease 120 is then folded such that panel 115 is perpendicular to both panels 112 and 110. The user may then insert the inner sleeve enclosed gift into the pre-wrapped gift box 505 as shown in FIGS. 29*a–c*.

After the inner sleeve enclosed gift is placed within the pre-wrapped gift box 505, the inner sleeve 122 may then be pulled from the inside of the pre-wrapped gift box 505 before it is closed as shown in FIG. 29*d*. This is accomplished by having the length of the inner sleeve 121 the same as or greater than the length of the pre-wrapped gift box 505 as shown in FIG. 28. Referring to FIG. 25, the length of the inner sleeve 121 and the pre-wrapped gift box 505 may be the same, c. Referring to FIGS. 29*c*, and 29*d*, if the inner sleeve 121 is to be removed, the user does so by pulling the protruding inner sleeve.

Alternatively, as shown in FIGS. 25 and 28, the inner sleeve 121 may be constructed such that its height is some fraction of an inch, x, less than that of the pre-wrapped gift box 505 so that the inner sleeve 121 can be left with the gift 501 inside the pre-wrapped gift box 505. The user may wish to leave the inner sleeve 121 inside the pre-wrapped gift box 505 for a more stable package, particularly in mailing. This can be achieved by marking the inner sleeve 121 such that the user can cut off x inches from the enclosed preformed inner sleeve 121 or the dual function volume sizer, or the inner sleeve 121 could be produced and sold with precut height c–x.

Additionally, a box loading device 195, as shown FIGS. 30 to 35 provides another means for more easily placing a gift into a box. This device may be used with the already described pre-wrapped gift box or with other boxes.

Referring now to FIG. 30, the upper cylinder 199 of the box loading device 195 is depicted unfolded for convenience of disclosure. The box loading device 195 may be made out of metal, plastic or some other appropriate material. In the first embodiment, constructed of metal, the box loading device 195 may include two structures, an upper hinged cylinder 199 and a lower support structure 198. These two elements may be attached by bolts 197 as shown in FIG. 34 or by welding or by some similar means. In another embodiment, constructutedfor example from a vacuum molded plastic, the hinged upper cylinder 199 and lower support structure 198 will exist as one element. As shown in FIG. 34, there must be a space, s, between the upper cylinder 199 and lower support structure 198 large enough so that an open ended box can easily be slid on and off of the box loading device 195.

As shown in FIG. 30 the upper hinged cylinder 199 includes four panels. The lower panel 201 is flat and rectangular. The upper panel 200 is minimally convex but with the same width as the lower panel 201. There are three differences between the upper panel 200 and lower panel 201. First, upper panel 200 is minimally convex while lower panel 201 is flat as shown in FIG. 31. Second, there is a semicircular cut out 211 at one end of upper panel 200. Third, the lower panel 201 has a length equal to the sum of the lengths of the pre-wrapped gift box major panels and flaps, while the upper panel 200 is the about the same length as the pre-wrapped gift box major panel. The invention teaches that the lower rectangular panel 201 must be long enough so that the pre-wrapped gift box can be slid so that the end of the box is flush with the end of box loading device. There are also two side panels. Side panel 202 is perpendicular to and is attached only to lower panel 201. Side panel 203 is perpendicular to and is attached to lower panel 201 and is also connected to upper panel 200 by hinge 209. Hinge 209 may be a piano hinge, a plastic hinge added as part of the vacuum molding production process, or any similar hinge device.

Additionally, as shown in FIG. 30, there are plastic flaps attached to the upper, lower and side panels 200, 201, 202, and 203. Flaps 204, 205, 206, 207 and 208 may be attached by staple, bolt or other fastening device; or they may be included as part of the vacuum molding process. As shown in FIG. 34, these flaps are attached and are contoured so that an open ended box 503 can be slid over the upper hinged cylinder 199 with ease.

The general dimensions of the upper hinged cylinder are smaller than those of the box with which it will be used. This is required so that open ended box 503 can easily slide onto the box loading device 195.

The typical method for using the box loading device 195 involves starting with an open upper hinged cylinder 199, and a gift 501 as shown in FIG. 32. The gift 501 may be wrapped with tissue paper or other packing means (not shown). The gift 501 is then placed into the open upper cylinder 199, and the cylinder 199 is closed as shown in FIG. 33*a*. At this point the gift 503 is enclosed by the upper cylinder 199. The open ended pre-wrapped gift box 503 is then easily slid over the flaps 204, 205, 206, and 207 and the upper cylinder 199 of the box loading device 195 in a direction of arrow A as shown in FIG. 33*b* and FIG. 34. At this point gift 501 is enclosed in the upper cylinder 199 which is enclosed by the open ended pre-wrapped gift box 503 as shown in FIG. 33*c*. The pre-wrapped gift box 503 is slid so that the end flaps are flush with the ends of the upper cylinder 199 of the box loading device 195. The upper portion of the pre-wrapped gift box 503 and the gift 501 may then be grasped at the location of semicircular cut out 211. In this way the gift 501 and pre-wrapped gift box 503 may be pulled from the upper cylinder 199 of the box loading device 195 in the direction of arrow B so that a pre-wrapped gift box enclosed gift results as shown in FIG. 33*d*. This device and method are particularly useful for shirt boxes and are also helpful in loading any open ended box.

Alternatively, the box loading device may be made such that it has a greater arc. As shown in FIG. 35*a*, *b*, *c*, and *d* a convex loading device 299 may be constructed from a lower flat rectangular panel 301 and an upper convex panel 300. Upper convex panel 300 may be hinged, or otherwise permanently attached, to lower panel 301 at 304 as shown in FIG. 35*c*. Flaps 310, 311, 312, 313, and 314 are attached to both upper convex panel 300 and lower panel 310 to allow a rectangular box to be easily slid over convex box loading device 299.

Convex box loading device 299 is useful for wrapping gifts 507 which are pliable and of a volume that can fit into an open ended box 503, but which have a shape which cannot easily be placed into an open ended box 503. As seen in FIG. 35*a*, the gift 507 is placed on flat surface 302 of the box loading device 299 and then slid in the direction of arrow C into the convex portion 300 of the box loading device 299. The open ended box 503 is then "scrunched" by the user, making the open ended box 503 more cylindrical than rectangular, and then slid easily over the guiding flaps 310, 311, 312, 313, and 314 in the direction of arrow D onto the convex upper portion 300 of the box loading device 299. The user then pulls the open ended box 503 and gift 507 out from the box loading device 299 together, along the direction indicated by arrow C by grasping the gift 507 and box 503 through the semicircular opening 306. The result is a pre-wrapped gift box enclosed gift.

Having now described the invention in accordance with the requirements of the patent statutes, those skilled in this art will have no difficulties making changes and modifications in the embodiment of the individual elements of the invention in order to meet their specific requirements or conditions. Such changes and modifications may be made without departing from the scope and spirit of the invention as set forth in the following claims.

What is claimed is:

1. A system for wrapping comprising:

a flattened, pre-wrapped gift box tube shaped to accommodate an article when erected; and a cantilevered platform having a gift chamber for supporting the article when configured for insertion in the erected box tube, the platform being sized to fit within the box tube when partially erected so that the partially erected box tube may be positioned to surround the article supported by the platform.

2. A system as claimed in claim 1 wherein the platform further comprises:

means for inserting the article into the gift chamber;

means for sliding the box tube around the gift chamber; and means for removing the box tube and the article from the chamber.

3. A system as claimed in claim 1 wherein the gift chamber further comprises a gift chamber having a convex top or bottom and being cantilever supported from a first end.

4. The invention of claim 2 wherein the means for inserting the article into the chamber further comprises:

means for opening the chamber during insertion.

5. The invention of claim 2, wherein the means for sliding the box tube onto the gift chamber further comprises:

flaps mounted at an end of the chamber for guiding the box tube around the chamber.

6. The invention of claim 2, wherein the means for removing the box tube and the article from the chamber further comprises:

a cutout in the chamber enabling the article to be compressed.

* * * * *